US005478697A

United States Patent [19]

Sakai et al.

[11] Patent Number: 5,478,697

[45] Date of Patent: Dec. 26, 1995

[54] METHOD FOR FORMING AN IMAGE

[75] Inventors: Minoru Sakai; Kazunobu Katoh; Hisashi Okamura, all of Kanagawa, Japan

[73] Assignee: Fuji Photo Film Co., Ltd., Kanagawa, Japan

[21] Appl. No.: 400,292

[22] Filed: Mar. 6, 1995

Related U.S. Application Data

[63] Continuation of Ser. No. 233,428, Apr. 28, 1994, abandoned.

[30] Foreign Application Priority Data

Apr. 28, 1993 [JP] Japan ..... 5-123273

[51] Int. Cl.[6] ..... G03C 1/06

[52] U.S. Cl. ..... 430/264; 430/298; 430/601; 430/610; 430/585; 430/435

[58] Field of Search ..... 430/264, 298, 430/601, 610, 585, 435

[56] References Cited

U.S. PATENT DOCUMENTS

| | | | |
|---|---|---|---|
| 4,241,164 | 12/1980 | Mifume et al. | 430/264 |
| 4,879,204 | 11/1989 | Ishigaki et al. | 430/512 |
| 5,139,921 | 8/1992 | Takagi et al. | 430/264 |
| 5,279,919 | 1/1994 | Okamura et al. | 430/264 |
| 5,288,590 | 2/1994 | Kuwabara et al. | 430/264 |
| 5,308,748 | 5/1994 | Ikegawa et al. | 430/585 |
| 5,316,889 | 5/1994 | Sakai | 430/264 |
| 5,316,890 | 5/1994 | Okamura et al. | 430/264 |

FOREIGN PATENT DOCUMENTS 456949 2/1992 Japan .

OTHER PUBLICATIONS

Keller, K., Science and Technology of Photography, pp. 17–20, Weinheim, 1993.

Keller, K., Science and Technology of Photography, pp. 88–92, Weinheim, 1993.

*Primary Examiner*—Thomas R. Neville

*Attorney, Agent, or Firm*—Sughrue, Mion, Zinn, Macpeak & Seas

[57] ABSTRACT

Silver halide photographic material is disclosed, which has provided on a support at least one silver halide emulsion layer which comprises silver halide grains containing a silver chloride of 50 mol % or more and at least one emulsion layer and other hydrophilic colloid layers contain at least one hydrazine derivative and at least one phosphonium salt compound.

9 Claims, No Drawings

METHOD FOR FORMING AN IMAGE

This is a continuation of application No. 08/233,428 filed Apr. 28, 1994, now abandoned.

BACKGROUND OF THE INVENTION

1. Field of the Invention

The present invention relates to a silver halide photographic material and a method for processing the same, in particular, to a silver halide photographic material which may be processed with a processing solution having a pH of less than 11.0 to give a high-contrast negative image useful in a photomechanical process.

2. Prior Art

Various additives have been proposed for the purpose of improving photographic properties (e.g., sensitivity, antifogging property, rapid processability) of silver halide photographic materials.

Addition of hydrazine compounds to silver halide photographic emulsions and developers is known, for example, in U.S. Pat. No. 3,730,727 (using a developer comprising ascorbic acid and a hydrazine compound in combination), U.S. Pat. No. 3,227,552 (using a hydrazine compound as an auxiliary developing agent for obtaining a direct positive color image), U.S. Pat. No. 3,386,831 (containing a β-monophenylhydrazide of an aliphatic carboxylic acid as the stabilizer for silver halide photographic materials), U.S. Pat. No. 2,419,975, and Mees, *The Theory of Photographic Process,* 3rd Ed. (1966), page 281.

Of these, there is disclosed in U.S. Pat. No. 2,149,975 addition of hydrazine compounds to obtain hard negative images.

The U.S. Pat. No. 2,149,975, disclosing a silver halide photographic material containing a hydrazine compound as added to the silver chlorobromide emulsion therein, mentions that when the photographic material is processed with a high-pH developer having a pH of 12.8, an extremely hard photographic image having a gamma (γ) value of more than 10 may be obtained. However, such a strongly-alkaline developer having a pH of nearly 13 is easily oxidized with air and is therefore unstable, so that it is not resistant to the storage or use for a long period of time.

Various modifications have been tried for processing a silver halide photographic material containing a hydrazine compound with a developer having a lower pH value to give a hard image.

JP-A-1-179939 and 1-179940 (the term "JP-A" as referred to herein means an "unexamined published Japanese patent application") have disclosed a method of processing a photographic material containing a nucleating development accelerator having a group adsorbing to silver halide emulsion grains and a nucleating agent also having a group adsorbing to the grains, with a developer having a pH of 11.0 or less. However, when the compound having an adsorbing group is added to silver halide emulsions in an amount exceeding a defined limit, it will detract from the light-sensitivity of the emulsions, or inhibit the developability thereof, or is harmful to other useful adsorbing additives. Therefore, the usable amount of the compound is limited so that even a photographic material containing the compound could not always express a sufficiently hard contrast.

In JP-A-60-140340 there is disclosed addition of amines to silver halide photographic materials to thereby elevate the hard contrast of the materials. However, when the materials are processed with a developer having a pH of less than 11.0, they could not express a sufficiently hard contrast.

In JP-A-56-106244 there is disclosed addition of amino compounds to developers having a pH of from 10 to 12 so as to elevate the contrast of the photographic materials processed therewith. However, the addition of amines to developers causes various problems that the developers come to emit offensive odors, the amines adhere to processing instruments to stain the processed materials and the wastes of the used developers cause environmental pollution. Therefore, it is desired to incorporate such amino compounds into photographic materials. However, photographic materials containing such amino compounds and providing sufficient advantages are not known up to the present.

In JP-A-61-167939 and 4-62544 there is disclosed addition of quaternary phosphonium salt compounds to developers to thereby elevate the hard contrast of the photographic materials processed therewith. However, the addition of such phosphonium salt compounds to developers caused a problem of environmental pollution. In addition, the contrast-elevating effect of the compounds is insufficient.

In JP-A-62-250439 and 62-280733 there is disclosed formation of hard images by processing photographic materials with developers having a pH of 11 or more and using hydrazine derivatives and quaternay onium salt compounds. Also in JP-A-61-47945, 61-47924, 1-179930 and 2-2542 there is disclosed formation of hard images by processing photographic materials with developers having a pH of 11 or more and using emulsions having a silver bromide content of 50 mol% or more and particular hydrazine compounds and quaternary onium salt compounds. However, since these use developers having a pH of 11 or more, the developers are easily oxidized with air and the properties of the processed photographic materials frequently vary due to the aging and fatigue of the developers being used.

In JP-A-4-51143, 4-56949 and 4-62544 there is disclosed processing of photographic materials containing particular hydrazine compounds along with amines, hydrazines and quaternary onium compounds, with developers having a pH of from 10.4 to 10.8.

Specifically, these laid-open specifications mention formation of hard images with γ of 10 or more, using particular hydrazine derivatives and particular accelerators in silver iodobromide emulsion systems. However, the rate of development of photographic materials having such constitution is low so that the gradation of the processed materials becomes soft, the sensitivity thereof is varied and the Dmax value thereof is lowered due to the variation of the composition of the fatigued developers. Thus, the photographic materials processed with the developers, especially the fatigued developers, could not have sufficient photographic properties. In addition, since the dyes previously contained in photographic materials could not fully be dissolved out or decomposed during the development of the materials with the developers of the kind so that the dyes often remain in the processed photographic materials to cause so-called color stains. Thus, the photographic materials processed by the disclosed techniques could not be put to practical use.

In U.S. Pat. Nos. 4,998,604 and 4,994,365 there are disclosed hydrazine compounds having a repeating unit of ethylene oxide and hydrazine compounds having a pyridinium group. However, as is obvious from their examples, the contrast of the photographic materials using the disclosed compounds is not sufficient and it is difficult to obtain photographic materials having a hard contrast and a necessary Dmax in practical processing conditions even though the disclosed compounds are used.

The photographic properties of nucleating hard photographic materials using hydrazine derivatives greatly fluctuate, depending on the variation of the pH value of the developers used for processing them. The pH value of developers greatly fluctuates, due to aerial oxidation of them, etc. Precisely, it lowers when developers are oxidized with air or when they are thickened due to evaporation of water therefrom, and it rises when developers absorb carbon dioxide from air. Given the situation, various attempts have heretofore been made at reducing the dependence of photographic properties on the pH of developers. According to the prior art that is heretofore been developed, however, it is still impossible to obtain photographic materials having a sufficiently hard contrast even when processed with developers having a pH of 11 or less and those capable of giving high-quality images even when processed with fatigued developers.

SUMMARY OF THE INVENTION

A first object of the present invention is to provide a silver halide photographic material which may be processed with a stable developer to give an extremely hard negative image with high-contrast gradation having a gamma value of more than 10.

A second object of the present invention is to provide a silver halide photographic material which may be processed with a developer having a pH of 11 or less to give a high-contrast negative image.

A third object of the present invention is to provide a silver halide photographic material not to give any substantial color stain even when processed with a developer having a pH of 11 or less.

Means for Solving the Problems:

The first object of the present invention has been attained by a silver halide photographic material having at least one light-sensitive silver halide emulsion layer on a support, in which the silver halide emulsion comprises silver halide grains having a silver chloride content of 50 mol % or more and the emulsion layer or at least one of other hydrophilic colloid layers contains at least one hydrazine derivative of the following general formula (I) and at least one phosphonium salt compound of the following general formula (II).

The second object of the present invention is attained by a photographic image forming method in which the silver halide photographic material mentioned above is processed with a developer containing a compound of the following formula (III) and a dihydroxybenzene-type developing agent in a ratio by concentration of from 0.03 to 0.12 and having a pH of from 9.0 to 11.0.

The third object of the present invention has been attained by the silver halide photographic material above in which the silver halide emulsion has been color-sensitized with a dye of the following general formula (IV).

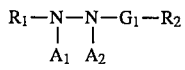

(I)

wherein $R_1$ represents an aliphatic group or an aromatic group, which contains, as a part of its substituents, a partial structure of —O—$(CH_2CH_2O)$n—, —O—$(CH_2CH(CH_3)O)$n— or —O—$(CH_2CH(OH)CH_2O)$n— (in which n is an integer of 3 or more), or contains, as a part of its substituents, a quaternary ammonium cation, or contains, as a part of its substituents, —S—;

$G_1$ represents —CO—, —COCO—, —CS—, —C(=$NG_2R_2$)—, —SO—, —$SO_2$—, or —P(O)($G_2R_2$)—;

$G_2$ represents a chemical bond, —O—, —S—, or —N($R_2$)—;

$R_2$ represents an aliphatic group, an aromatic group, or a hydrogen atom, and when the molecule has plural $R_2$'s, they may be the same or different; and one of $A_1$ and $A_2$ is a hydrogen atom, while the other represents a hydrogen atom, an acyl group, or an alkyl- or arylsulfonyl group.

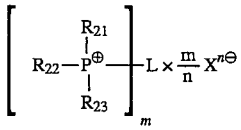

(II)

wherein $R_{21}$, $R_{22}$ and $R_{23}$ each represent an alkyl group having 1 to 30, preferably 1 to 15 carbon atoms, a cycloalkyl group having 1 to 30, preferably 1 to 15 carbon atoms, an aryl group having 6 to 30, preferably 6 to 15 carbon atoms, an alkenyl group, a cycloalkenyl group or a heterocyclic group having 1 to 30, preferably 1 to 15 carbon atoms, which may optionally be substituted;

m represents 1 or 2;

L represents an m-valent organic group which is bonded to the P atom in the formula via its carbon atom;

n represents an integer of from 1 to 3; and

X represents an n-valent anion, and X may be linked to L.

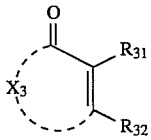

(III)

wherein $R_{31}$ and $R_{32}$ each represent a hydroxyl group, an amino group, an acylamino group, an alkylsulfonylamino group, an arylsulfonylamino group, an alkoxycarbonylamino group, a mercapto group, or an alkylthio group having 1 to 30, preferably 1 to 5 carbon atoms; and $X_3$represents an atomic group necessary for forming a 5-membered or 6-membered ring along with the two vinyl carbon atoms substituted by $R_{31}$ and $R_{32}$ and the carbonyl carbon atom in the formula.

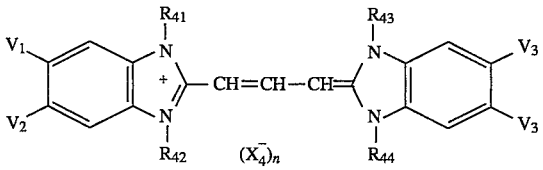

(IV)

wherein $V_1$ and $V_3$ each represent a hydrogen atom or an electron-attracting group; $V_2$ and $V_4$ each represent an electron-attracting group;

$R_{41}$, $R_{42}$, $R_{43}$ and $R_{44}$ may be the same or different and each represents an optionally substituted alkyl or alkenyl group having 10 or less carbon atoms in total, and at least one of $R_{41}$, $R_{42}$, $R_{43}$ and $R_{44}$ is a group having a sulfo group or a carboxyl group;

$X_4$ represents a counter ion necessary for neutralizing the charge of the compound; and n represents 0 or 1, and when the compound forms an internal salt, then n is 0.

DETAILED DESCRIPTION OF THE INVENTION

Formula (I) will be explained in more detail hereunder.

In formula (I), the aliphatic group of $R_1$ preferably has from 1 to 30 carbon atoms and is especially a linear, branched or cyclic alkyl group having from 1 to 20 carbon atoms. The alkyl group is substituted.

In formula (I), the aromatic group having from 6 to 30 carbon atoms of $R_1$ is a mono-cyclic or bi-cyclic aryl group or an unsaturated heterocyclic group. The unsaturated heterocyclic group may be condensed with an aryl group to form a heteroaryl group.

For instance, mentioned are benzene rings, naphthalene rings, pyridine rings, quinoline rings, isoquinoline rings, etc. Of these, preferred are groups containing benzene ring(s).

$R_1$ is especially preferably an aryl group.

The aliphatic group or aromatic group, represented by $R_1$ has substituent(s), typical examples of which include, for example, an alkyl group, an aralkyl group, an alkenyl group, an alkynyl group, an alkoxy group, an aryl group, a substituted amino group, an ureido group, an urethane group (e.g., an alkoxycarbonylamino group, an aryloxycarbonylamino group),an aryloxy group, a sulfamoyl group, a carbamoyl group, an alkylthio group, an arylthio group, a sulfonyl group, a sulfinyl group, a hydroxyl group, a halogen atom (e.g., F, Cl, Br), a cyano group, —$SO_3M'$, —COOM' (where M' is a hydrogen atom, an alkali metal, a quaternary ammonium group or an alkaline earth metal), an aryloxycarbonyl group, an acyl group, an alkoxycarbonyl group, an acyloxy group, a carbonamido group, a sulfonamido group, and a phosphoric acid amide group. Of these, preferred are a linear, branched or cyclic alkyl group (preferably having from 1 to 20 carbon atoms), an aralkyl group (preferably having from 7 to 30 carbon atoms), an alkoxy group (preferably having from 1 to 30 carbon atoms), a substituted amino group (preferably substituted by alkyl group(s) having from 1 to 30 carbon atoms), an acylamino group (preferably having from 2 to 40 carbon atoms), a sulfonamido group (preferably having from 1 to 40 carbon atoms), an ureido group (preferably having from 1 to 40 carbon atoms), and a phosphoric acid amide group (preferably having from 1 to 40 carbon atoms).

The aliphatic group or aromatic group of $R_1$ or a part of the substituents of $R_1$ contain(s) —O—$(CH_2CH_2O)_n$—, —O$(CH_2CH(CH_3)O)_n$— or —O—$(CH_2CH(OH)CH_2O)_n$— (where n is an integer of 3 or more, preferably an integer of from 3 to 15), or contain(s) a quaternay ammonium cation (for example, having, as the counter anion, fluoride ion, chloride ion, bromide ion, iodide ion, toluenesulfonato ion, naphthalenesulfonato ion, etc., or having, as the anion, $SO_3$—, $COO^-$, etc.), or contain(s) —S—.

$R_1$ is preferably represented by the following formula (Ia), (Ib), (Ic), (Id) or (Ie):

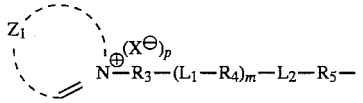

(Ia)

-continued

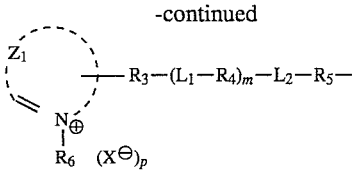

(Ib)

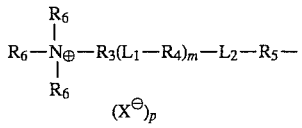

(Ic)

$$R_6-O-(L_3)_n-R_3-(L_1-R_4)_m-L_2-R_5- \quad \text{(Id)}$$

$$R_6-S-R_3-(L_1-R_4)_m-L_1-R_5- \quad \text{(Ie)}$$

In these formulae, $L_1$ and $L_2$ may be the same or different and each represents —$CONR_7$—, —$NR_7CONR_8$—, —$SO_2NR_7$— or —$NR_7SO_2NR_8$—. $R_7$ and $R_8$ each represents a hydrogen atom, an alkyl group having from 1 to 6 carbon atoms, or an aryl group having from 6 to 10 carbon atoms. They are preferably hydrogen atoms m and p each represent 0 or 1.

$R_3$ and $R_4$ each represent a divalent aliphatic or aromatic group. Preferably, they each are an alkylene group, an arylene group, or a divalent group to be formed by combining with —O—, —CO—, —S—, —SO—, —$SO_2$— and/or —$NR_9$— (where $R_9$ has the same meaning as $R_7$ in formulae (Ia), (Ib) and (Ic)). The aliphatic group is more preferably an alkylene group; and the aromatic group is more preferably an arylene group.

$R_5$ represents an aliphatic group, an aromatic group, or a group to be formed in combination thereof. Preferably, it is an alkylene group, or an arylene group combined with alkylene group(s).

$R_3$, $R_4$ and $R_5$ may optionally be substituted. As preferred examples of the substituents for them, those for $R_1$ mentioned hereinabove are referred to.

In formulae (Ia) and (Ib), $Z_1$ represents an atomic group necessary for forming a nitrogen-containing aromatic ring. Preferred examples of the nitrogen-containing heterocyclic aromatic rings to be formed by $Z_1$ and nitrogen atom(s) include pyridine rings, pyrimidine rings, pyridazine rings, pyrazine rings, imidazole rings, pyrazole rings, pyrrole rings, oxazole rings, thiazole rings, and their benzo-condensed rings, and also puteridine rings, and naphthyridine rings.

In formulae (Ia), (Ib) and (Ic), when p=1, $X^-$ represents a counter anion (e.g., fluoride ion, chloride ion, bromide ion, iodide ion, toluenesulfonato ion, naphthalenesulfonato ion). When p=0, $Z_1$ or $R_6$ has $SO_3$— or COO— to form an internal salt.

In formulae (Ib), (Ic), (Id) and (Ie), $R_6$ represents an aliphatic group or an aromatic group. Preferably, $R_6$ is an alkyl group having from 1 to 20 carbon atoms, or an aryl group having from 6 to 20 carbon atoms.

Three $R_6$'s in formula (Ic) may be the same or different or may be bonded to each other to form a ring. Preferably, however, they do not form a ring.

$Z_1$ and $R_6$ may optionally be substituted. As preferred examples of the substituents for them, those for $R_1$ mentioned hereinabove are referred to.

In formula (Id), $L_3$ represents —$CH_2CH_2O$—, —$CH_2CH(CH_3)O$— or —$CH_2CH(OH)CH_2O$—, and n has the same meaning as that in formula (I).

$G_1$ in formula (I) is preferably —CO— or —$SO_2$—, most preferably —CO—.

$A_1$ and $A_2$ are preferably hydrogen atoms.

In formula (I), the alkyl group of $R_2$ is preferably an alkyl group having from 1 to 4 carbon atoms and the aryl group thereof is preferably a mono-cyclic or bi-cyclic aryl group (for example, containing benzene ring(s)).

When $G_1$ is —CO—, then $R_2$ is preferably a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl), an aryl group (e.g., phenyl, 3,5-dichlorophenyl, o-methanesulfonamidophenyl, 4-methanesulfonylphenyl, 2-hydroxymethylphenyl) and is especially preferably a hydrogen atom.

$R_2$ may optionally be substituted. As preferred examples of the substituents for this, those for $R_1$ mentioned hereinabove are referred to.

$R_2$ may be such a group that functions to release the —$G_1$—$R_2$ moiety from the remaining molecule to cause cyclization for forming a cyclic structure containing the atoms of the —$G_1$—$R_2$ moiety. As examples of the group of $R_2$, for example, mentioned are the groups in Compound Nos. 28, 37 and 40 described in JP-A-63-29751.

$R_1$ or $R_2$ in formula (I) may have therein a ballast group or a polymer moiety which is generally employed in immobilized photographic additives such as couplers. The ballast group is relatively inactive to photographic properties and has 8 or more carbon atoms, including, and it may be selected from, for example, an alkyl group, an alkoxy group, a phenyl group, a phenylalkyl group, a phenoxy group and an alkylphenoxy group. As the polymer moiety, for example, mentioned are those described in JP-A 1-100530.

$R_1$ or $R_2$ in formula (I) may have therein a group which strengthen the adsorbability of the compound to the surfaces of silver halide grains. As examples of such adsorbing groups, mentioned are a thiourea group, a heterocyclic thioamido group, a mercapto-heterocyclic group, a triazole group and the like described in U.S. Pat. Nos. 1,385,108, 4,459,347, JP-A-59-195233, 59-200231, 59-201045, 59-201046, 59-201047, 59-201048, 59-201049, 61-170733, 61-270744, 62-948, 63-234244, 63-234245, and 63-234246.

Of the compounds of formula (I) which are used in the present invention, those of formulae (Ib) and (Ic) are especially preferred. More preferred are the compounds of formula (Ic).

The compounds of formula (I) may be produced, for example, utilizing the methods described in JP-A-61-213847, 62-260153, U.S. Pat. No. 4,684,604, Japanese Patent Application No. 63-98803, U.S. Pat. Nos. 3,379,529, 3,620,746, 4,377,634, 4,332,878, JP-A-49-129536, 56-153,336, 56-153342, U.S. Pat. Nos. 4,988,604, 4,994,365.

Specific examples of the compounds of formula (I) which may be used in the present invention are mentioned below, but these are not limitative.

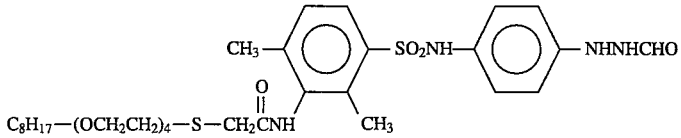

I-1

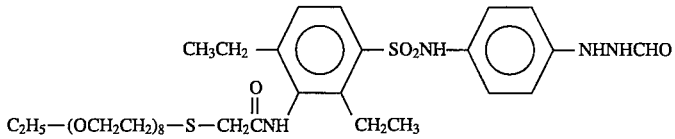

I-2

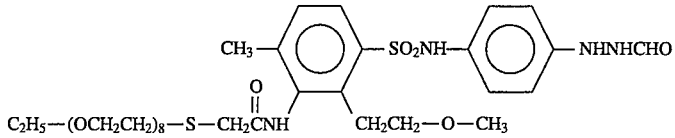

I-3

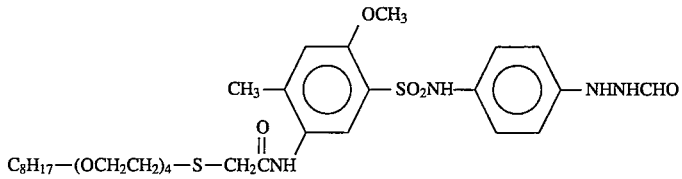

I-4

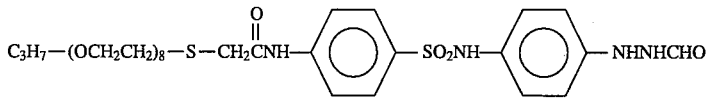

I-5

-continued
I-6
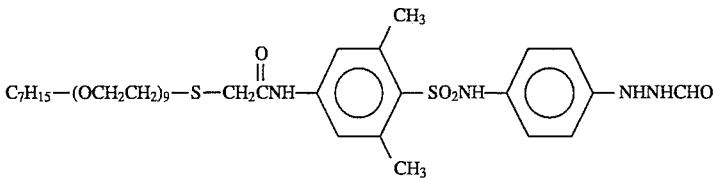
I-7
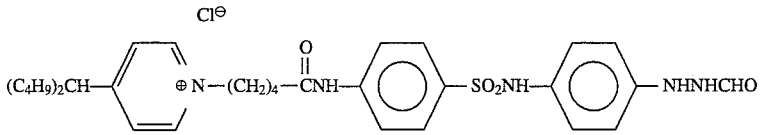
I-8
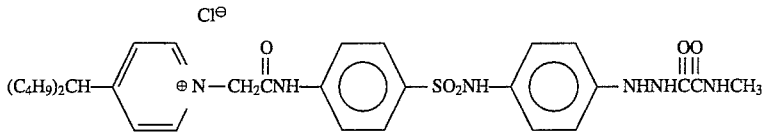
I-9
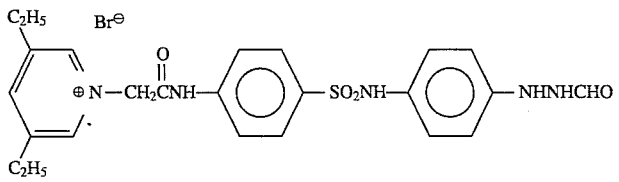
I-10
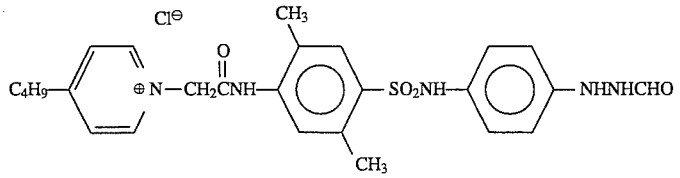
I-11
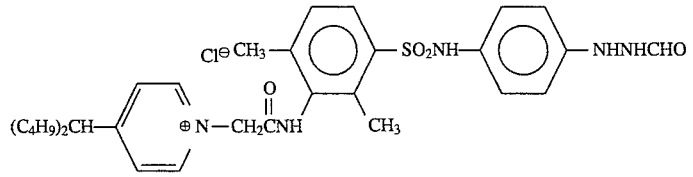
I-12
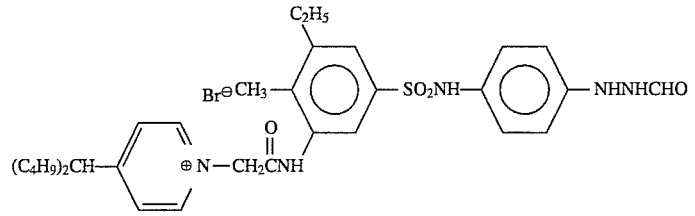
I-13
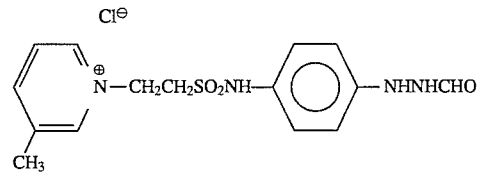
I-14
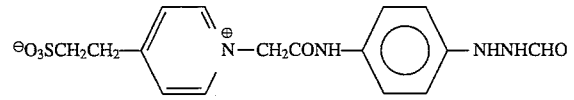

-continued
I-15
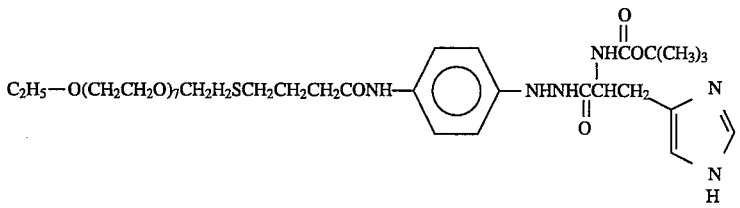
I-16
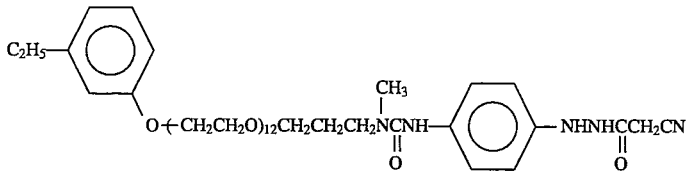
I-17
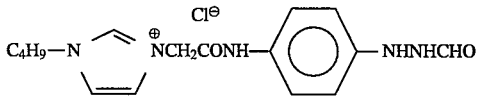
I-18
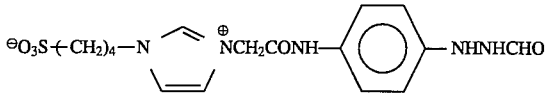
I-19
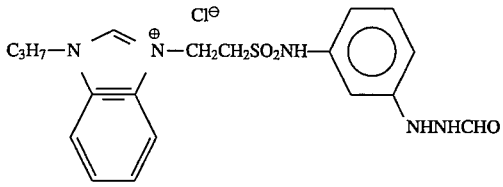
I-20
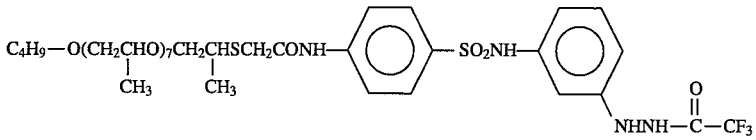
I-21
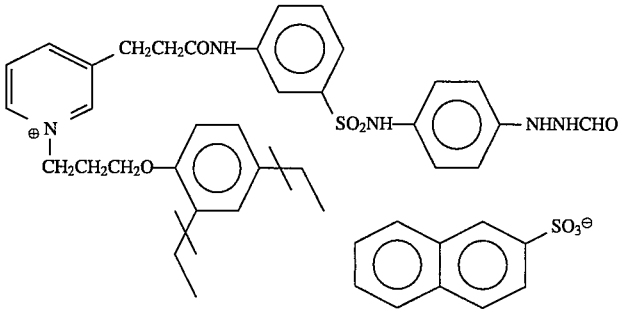
I-22
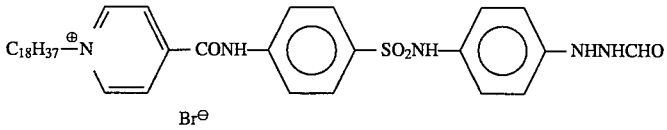
I-23
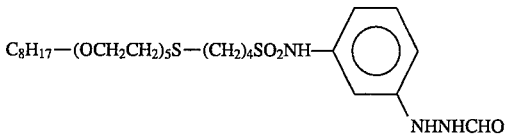

-continued
I-24
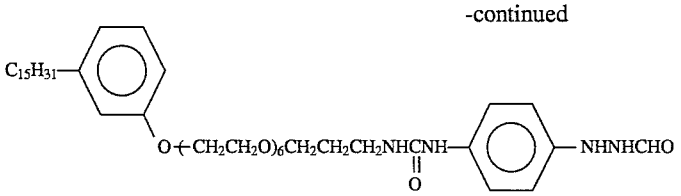
I-25
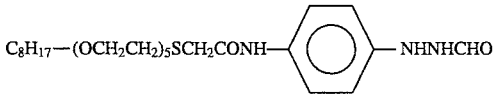
I-26
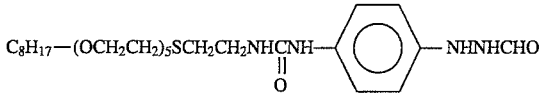
I-27
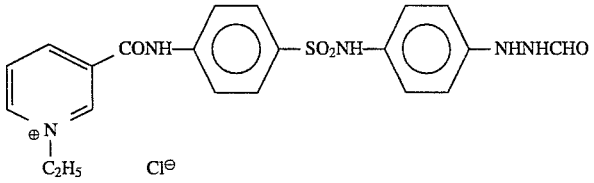
I-28
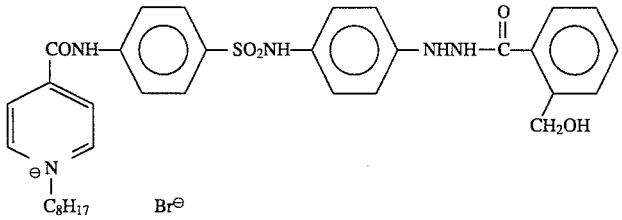
I-29
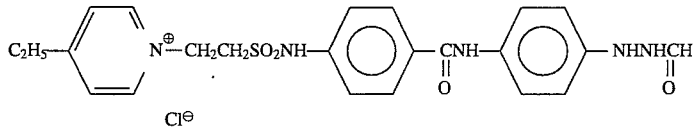
I-30
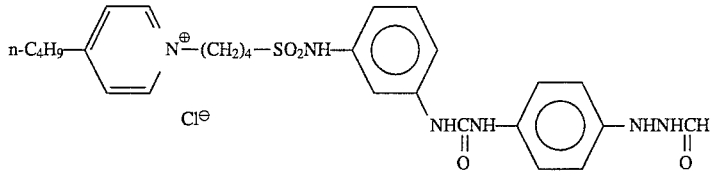
I-31
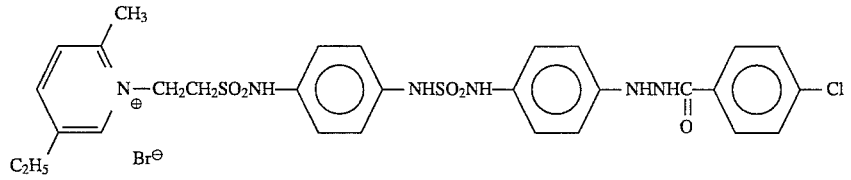
I-32
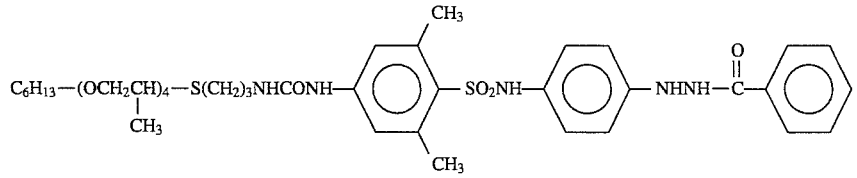
I-33
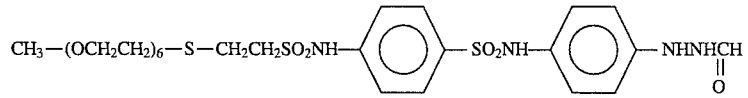

-continued
I-34
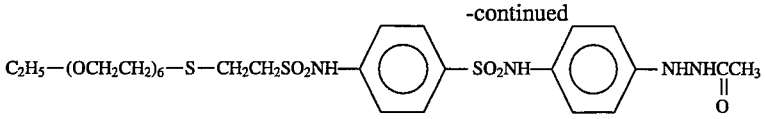
I-35
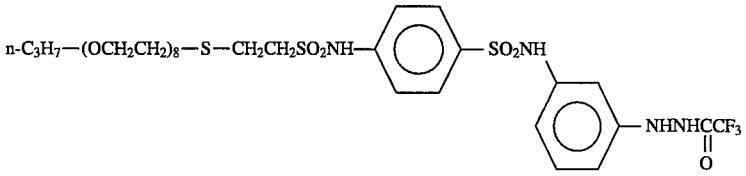
I-36
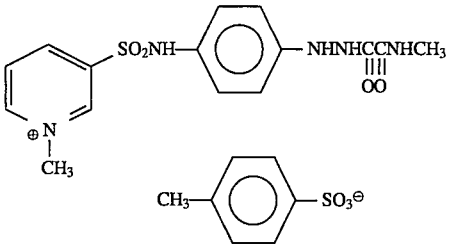
I-37
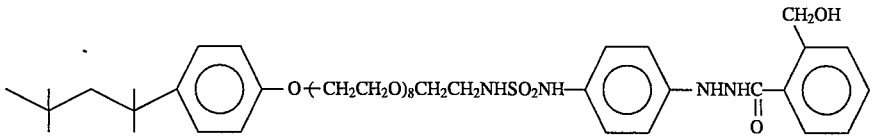
I-38
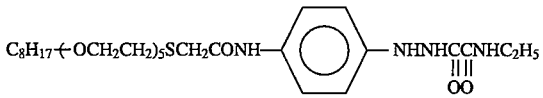
I-39
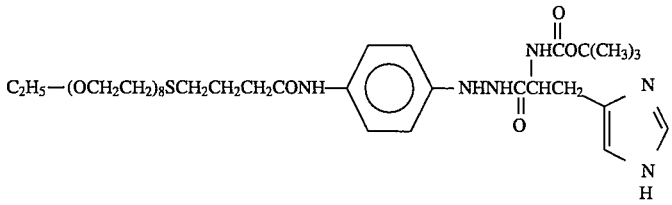
I-40
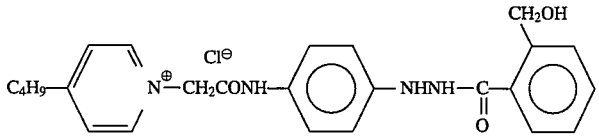
I-41
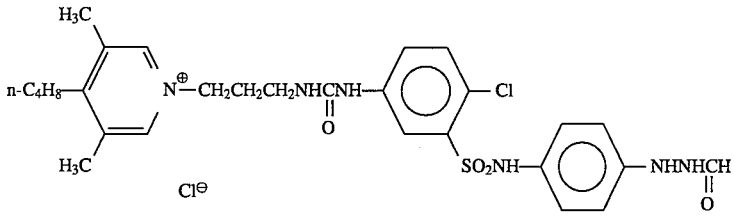
I-42
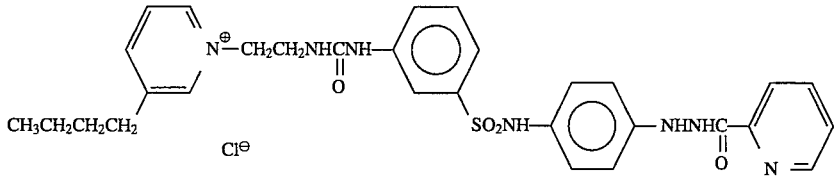

-continued
I-43
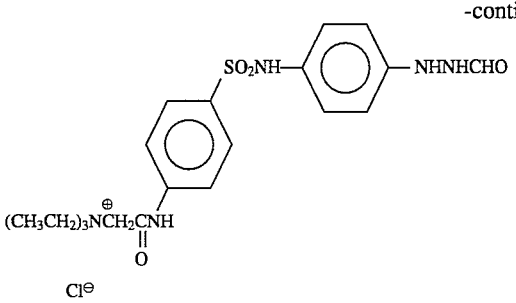
I-44
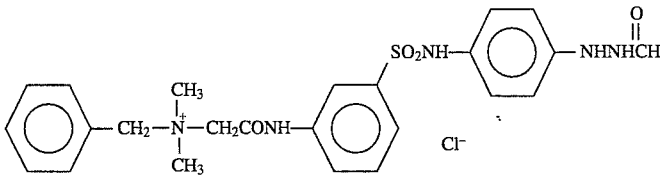
I-45
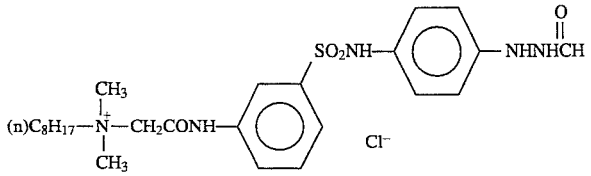
I-46
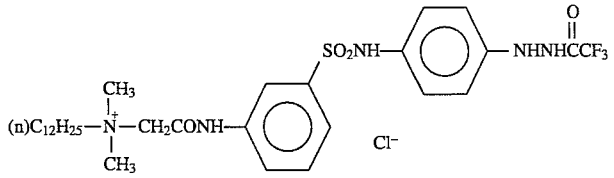
I-47
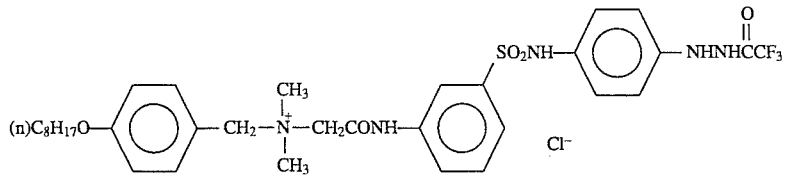
I-48
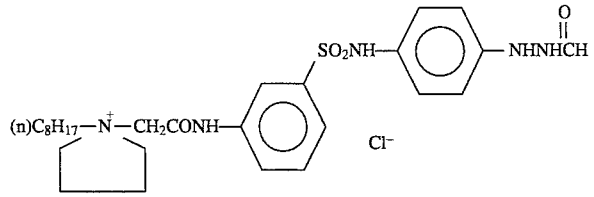
I-49
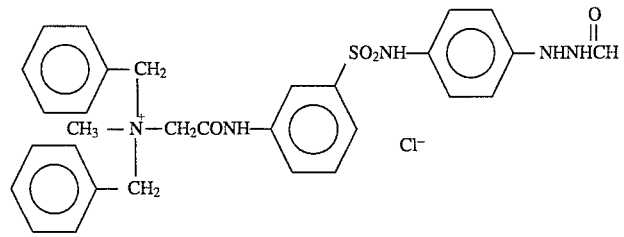
I-50
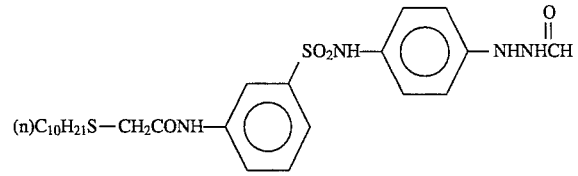

-continued
I-51
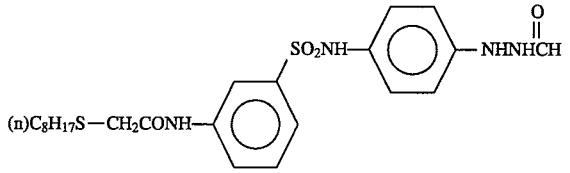
I-52
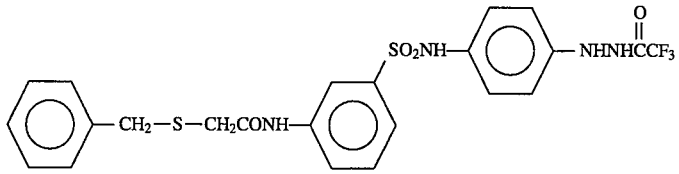
I-53
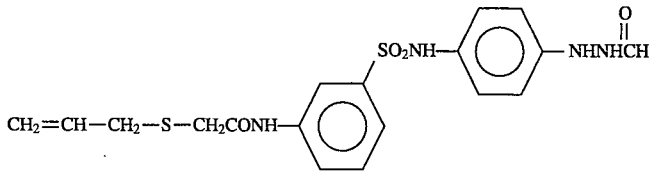
I-54
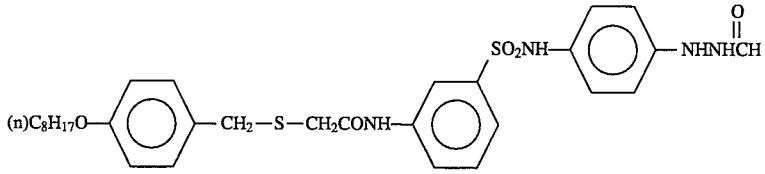
I-55
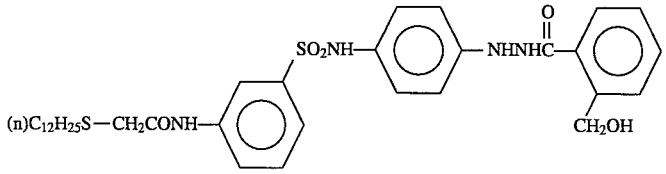
I-56
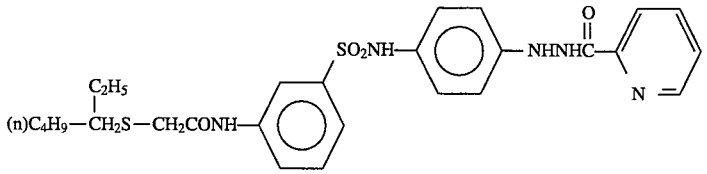
I-57
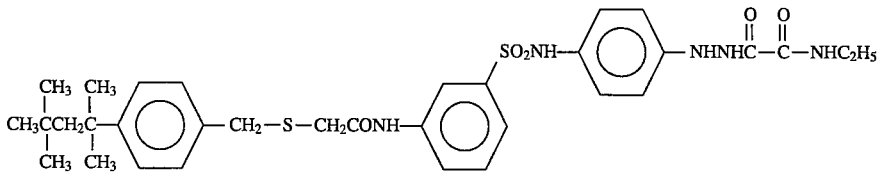
The amount of the compound of formula (I) to be added to the photographic material of the present invention is preferably from $1\times10^{-6}$ mol to $5\times10^{-2}$ mol, especially preferably from $1\times10^{-5}$ mol to $2\times10^{-2}$ mol, per mol of silver halide.
Formula (II) will be explained in detail hereunder.
(II)
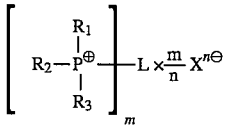

wherein $R_{21}$, $R_{22}$ and $R_{23}$ each represents an alkyl group, a cycloalkyl group, an aryl group, an alkenyl group, a cycloalkenyl group or a heterocyclic group, which may optionally have substituent(s);

m represents an integer of 1 or 2;

L represents an m-valent organic group which is bonded to the P atom via its carbon atom;

n represents an integer of from 1 to 3;

X represents an n-valent anion, and X may be linked to L.

Examples of the groups of $R_{21}$, $R_{22}$ and $R_{23}$ include a linear or branched alkyl group such as a methyl group, an ethyl group, a propyl group, an isopropyl group, a butyl group, an isobutyl group, a sec-butyl group, a tert-butyl group, an octyl group, a 2-ethylhexyl group, a dodecyl group, a hexadecyl group, or an octadecyl group; a cycloalkyl group such as a cyclopropyl group, a cyclopentyl group or a cyclohexyl group; an aryl group such as a phenyl group, a naphthyl group or a phenanthryl; an alkenyl group such as an allyl group, a vinyl group or a 5-hexenyl group; a cycloalkenyl group such as a cyclopentenyl group or a cyclohexenyl group; and a heterocyclic group such as a pyridyl group, a quinolyl group, a furyl group, an imidazolyl group, a thiazolyl group, a thiadiazolyl group, a benzotriazolyl group, a benzothiazolyl group, a morpholyl group, a pyrimidyl group or a pyrrolidyl group. As examples of the substituents for these groups, mentioned are the groups of $R_1$, $R_2$ and $R_3$ and also a halogen atom (e.g., fluorine atom, chlorine atom, bromine atom, iodine atom) , a nitro group, a primary, secondary or tertiary amino group, an alkyl or arylether group, an alkyl or arylthioether group, a carbonamido group, a carbamoyl group, a sulfonamido group, a sulfamoyl group, a hydroxyl group, a sulfoxy group, a sulfonyl group, a carboxyl group, a sulfonic acid group, a cyano group and a carbonyl group. As examples of the group of L, mentioned are the groups having the same definitions as those of $R_{21}$, $R_{22}$ and $R_{23}$, and also a polymethylene group (e.g., trimethylene, tetramethylene, hexamethylene, pentamethylene, octamethylene, dodecamethylene), a divalent aromatic group (e.g., phenylene, biphenylene, naphthylene), a polyvalent aliphatic group (e.g., trimethylenemethyl, tetramethylenemethyl), and a polyvalent aromatic group (e.g., phenylene-1,3,5-toluyl, phenylene-1,2,4,5-tetrayl) .

As examples of the anion of X, mentioned are a halide ion (e.g., chloride ion, bromide ion, iodide ion), a carboxylato ion (e.g., acetato, oxalato, fumarato, benzoato), a sulfonato ion (e.g., p-toluenesulfonato, methanesulfonato, butanesulfonato, benzenesulfonato), a sulfato ion, a perchlorato ion, a carbonato ion, and a nitrato ion.

In formula (II), $R_{21}$, $R_{22}$ and $R_{23}$ each represents preferably a group having 20 or less carbon atoms and are especially preferably an aryl group having 15 or less carbon atoms. m is preferably 1 or 2. When m is 1, L is preferably a group having 20 or less carbon atoms, especially preferably an alkyl or aryl group having 15 or less carbon atoms in total. When m is 2, the divalent organic group of L is preferably an alkylene or arylene group, or a divalent group to be formed by combining the groups, or a divalent group to be formed by combining the groups along with —CO—, —O—, —$NR_{24}$— (where $R_{24}$ is a hydrogen atom or has the same meaning as $R_{21}$, $R_{22}$ or $R_{23}$, and plural $R_{24}$'s, may be the same or different or may be bonded together), —S—, —SO— and/or —$SO_2$—. When m is 2, L is especially preferably a divalent group having 20 or less carbon atoms in total, which is bonded to the P atom in the molecule via its carbon atom. When m is an integer of 2, the molecule has plural $R_{21}$'s, $R_{22}$'s and $R_{23}$'s, and they may be the same or different.

n is preferably 1 or 2. X may be bonded to $R_{21}$, $R_{22}$, $R_{23}$ or L to form an internal salt.

Most of the compounds of formula (II) for use in the present invention are known and are commercially available as chemical reagents. As general methods for producing them, mentioned are a method of reacting a phosphinic acid and an alkylating agent such as alkyl halides or sulfonates, and also a method of exchanging the counter anion of phosphonium salts by ordinary means.

Specific examples of the compounds of formula (II) for use in the present invention are mentioned below, which, however, are not limitative.

II-1

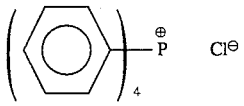

II-2

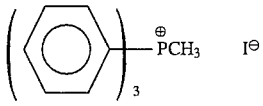

II-3

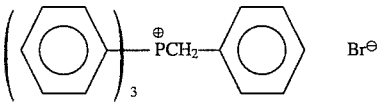

II-4

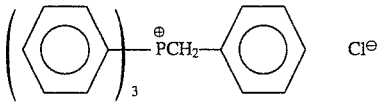

II-5

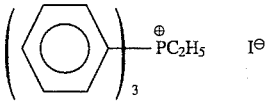

II-6

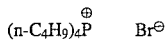

II-7

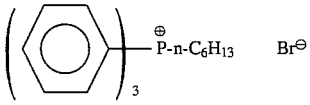

II-8

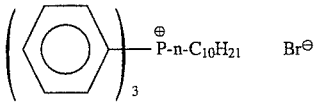

-continued

II-9

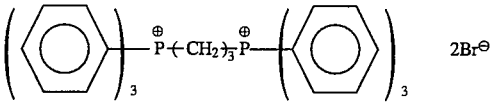

II-10

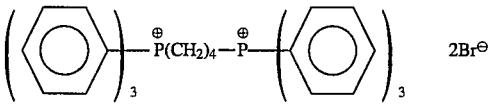

II-11

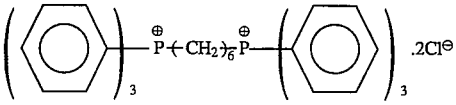

II-12

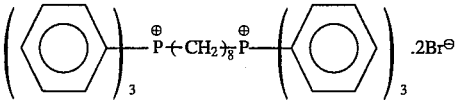

II-13

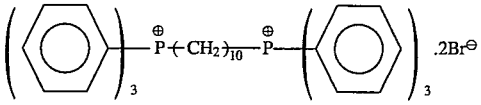

II-14

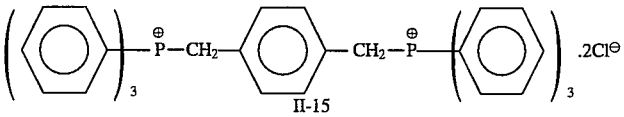

II-15

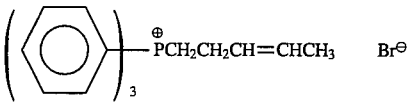

II-16

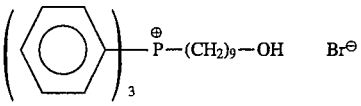

II-17

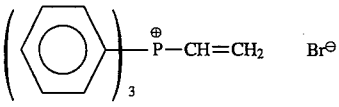

II-18

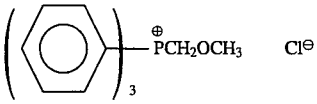

II-19

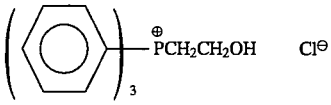

II-20

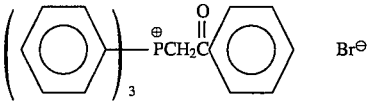

II-21

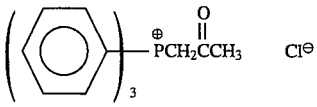

II-22

$(n\text{-}C_4H_9)_3\overset{\oplus}{P}CH_2CH_2OH$ $Br^{\ominus}$

II-23

$(n\text{-}C_4H_9)_3\overset{\oplus}{P}C_2H_5 \times \frac{1}{2} \times SO_4^{2\ominus}$

II-24

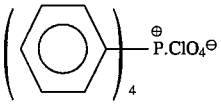

II-25

$Ph_3\overset{\oplus}{P}-(CH_2)_4COOH$ $Br^{\ominus}$

II-26

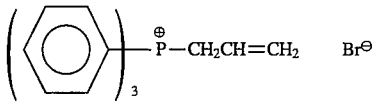

II-27

$(n\text{-}C_4H_9)_3\overset{\oplus}{P}\text{-}n\text{-}C_{16}H_{33}$ $Br^{\ominus}$

II-28

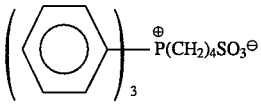

II-29

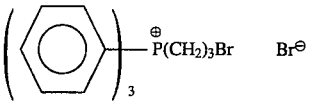

II-30

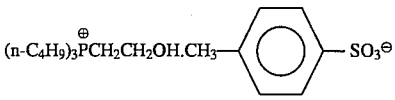

II-31

$(n\text{-}C_4H_9)_3\overset{\oplus}{P}CH_3I^{\ominus}$

II-32

$(HOCH_2)_3\overset{\oplus}{P}CH_3I^{\ominus}$

-continued
II-33
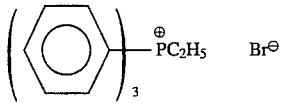
II-34
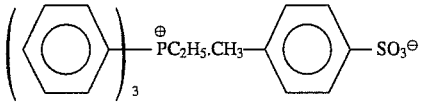
II-35
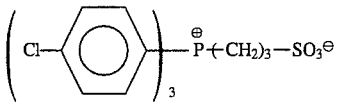
II-36
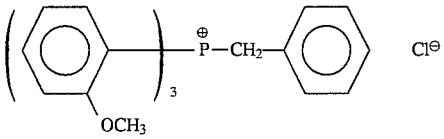
II-37
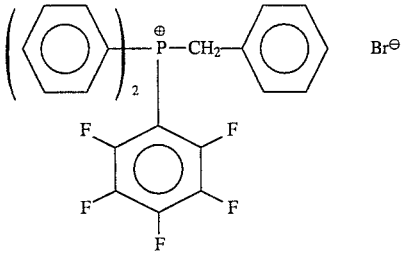
II-38
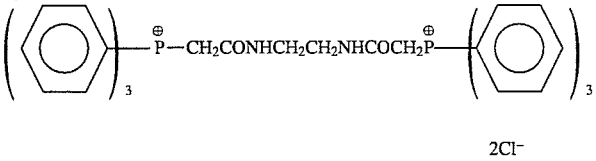
II-39
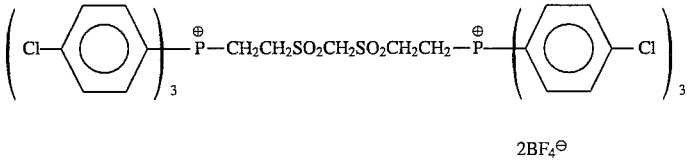
II-40
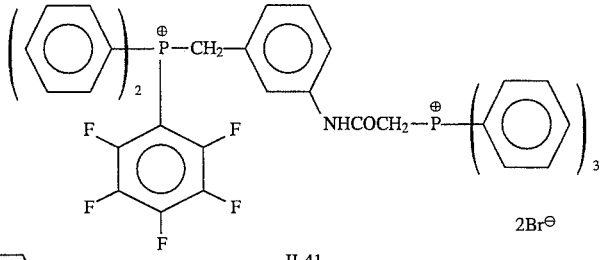
II-41
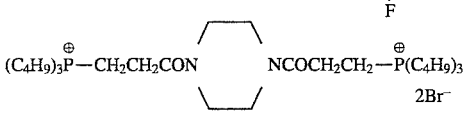
II-42
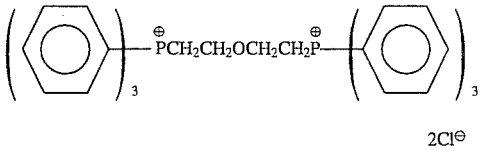
II-43
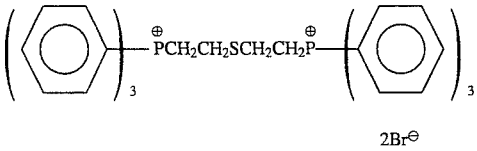
II-44
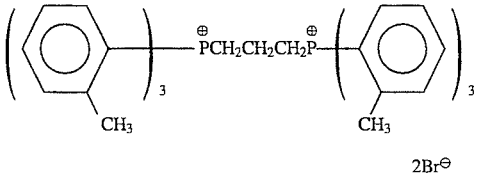

-continued

II-45

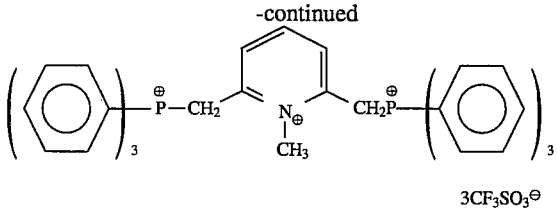

The amount of the compound of formula (II) to be added to the photographic material of the present invention is not specifically limited but is preferably within the range of from $1\times10^{-5}$ mol to $2\times10^{-2}$ mol, more preferably from $2\times10^{-5}$ mol to $1\times10^{-2}$ mol, per mol of silver halide.

Where the compound of formula (II) is incorporated into the photographic material of the present invention, its aqueous solution may be added to the silver halide emulsion or hydrophilic colloid for forming the material when the compounds are soluble in water, while its solution in a water-miscible organic solvent such as alcohols (e.g., methanol, ethanol), esters (e.g., ethyl acetate) or ketones (e.g., acetone) may be added to the same when the compounds are insoluble in water.

Next, formula (III) will be explained.

In formula (III), $R_{31}$ and $R_{32}$ each represents a hydroxyl group, an amino group, an acylamino group, an alkylsulfonylamino group, an arylsulfonylamino group, an alkoxycarbonylamino group, a mercapto group or an alkylthio group; and $X_3$ represents an atomic group necessary for forming a 5-membered or 6-membered ring along with the two vinyl carbons substituted by $R_{31}$ and $R_{32}$ and the carbonyl carbon in the formula.

In formula (III), $R_{31}$ and $R_{32}$ each represents a hydroxyl group, an amino group (optionally substituted by alkyl group(s) having from 1 to 10 carbon atoms, such as methyl, ethyl, n-butyl, hydroxyethyl), an acylamino group (e.g., acetylamino, benzoylamino), an alkylsulfonylamino group (e.g., methanesulfonylamino), an arylsulfonylamino group (e.g., benzenesulfonylamino, ptoluenesulfonylamino), p-toluenesulfonylamino), an alkoxycarbonylamino group (e.g., methoxycarbonylamino), a mercapto group, or an alkylthio group (e.g., methylthio, ethylthio). $R_{31}$ and $R_{32}$ each are preferably a hydroxyl group, an amino group, an alkylsulfonylamino group, or an arylsulfonylamino group.

$X_3$ is composed of carbon, oxygen and/or nitrogen atoms to form a 5-membered or 6-membered ring along with the two vinyl carbons substituted by $R_{31}$ and $R_{32}$ and the carbonyl carbon in the formula. As specific examples of $X_3$, mentioned are combinations of the groups chosen from among —O—, —C($R_{33}$)($R_{34}$)—, —C($R_{35}$)=, —c(=O)—, —N($R_{36}$)— and —N=, in which $R_{33}$, $R_{34}$, $R_{35}$ and $R_{36}$ each represent a hydrogen atom, an optionally substituted alkyl group having from 1 to 10 carbon atoms (as the substituents, for example, mentioned are a hydroxyl group, a carboxyl group and a sulfo group), an optionally substituted aryl group having from 6 to 15 carbon atoms (as the substituents, for example, mentioned are an alkyl group, a halogen atom, a hydroxyl group, a carboxyl group, and a sulfo group), a hydroxyl group or a carboxyl group. The 5-membered or 6-membered ring may also be in the form of a saturated or unsaturated, condensed ring.

As examples of the 5-membered or 6-membered ring, mentioned are dihydrofuranone rings, dihydropyrone rings, pyranone rings, cyclopentenone rings, cyclohexenone rings, pyrrolinone rings, pyrazolinone rings, pyridone rings, azacyclohexanone rings and uracil ring. Of these, preferred are dihydrofuranone rings, cyclopentenone rings, cyclohexenone rings, pyrazolinone rings, azacyclohexanone rings and uracil rings.

Specific examples of the compounds of formula (III) for use in the present invention are mentioned below, which, however, are not limitative.

III-1

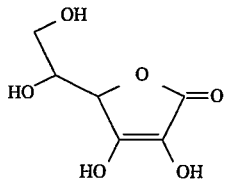

III-2

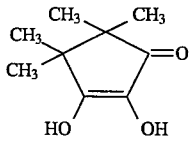

III-3

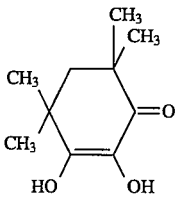

III-4

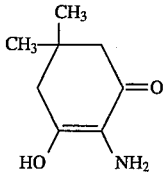

III-5

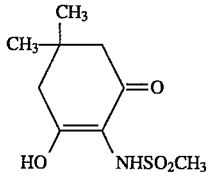

III-6

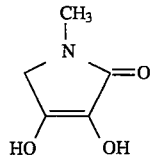

III-7

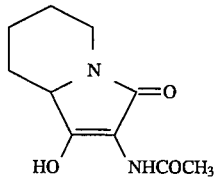

-continued

III-8

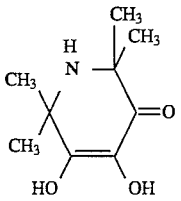

III-9

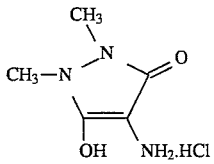

III-10

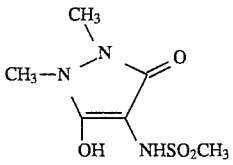

III-11

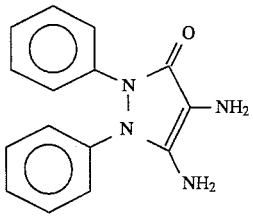

III-12

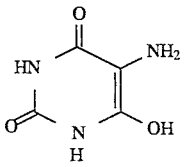

III-13

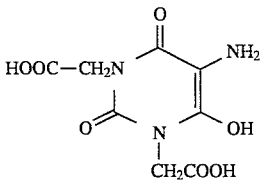

III-14

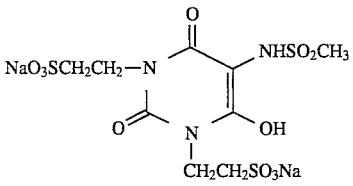

III-15

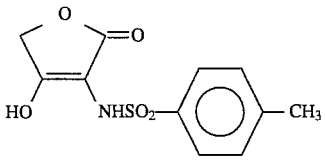

III-16

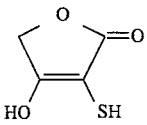

-continued

III-17

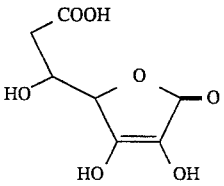

III-18

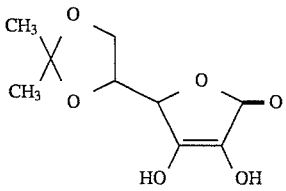

III-19

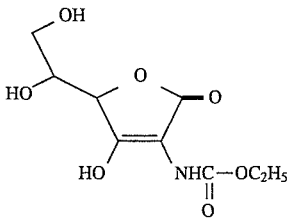

III-20

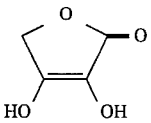

III-21

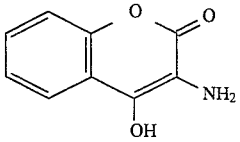

III-22

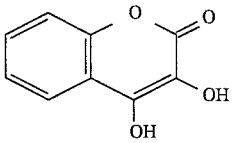

Of these, preferred is ascorbic acid or erysorbic acid (stereoisomer) (III-1). The amount of the compound of formula (III) to be added to the developer to be used in processing the photographic material of the present invention is within the range of from 0.03 to 0.12 as the ratio by concentration of (compound of formula (III)/hydroquinone-type developing agent), which is obtained by dividing the concentration of the compound of formula (III) by the concentration of the hydroquinone-type developing agent to be in the developer. The ratio is preferably from 0.03 to 0.10, especially preferably from 0.05 to 0.09.

The hydroquinone developing agent to be in the developer for use in the present invention includes, for example, hydroquinone, chlorohydroquinone, bromohydroquinone, isopropylhydroquinone, methylhydroquinone, 2,3-dibromohydroquinone and 2,5-dimethylhydroquinone. Of these, especially preferred is hydroquinone. The concentration of the hydroquinone derivative in the developer is from 0.2 to 0.75 mol/liter, preferably from 0.2 to 0.5 mol/liter, especially preferably from 0.2 to 0.4 mol/liter.

Next, the sensitizing dyes of formula (IV) for use in the present invention are mentioned below.

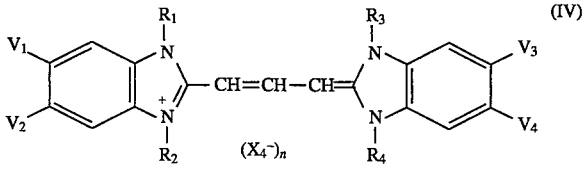

(IV)

wherein $V4_1$ and $V4_3$ each represents a hydrogen atom or an electron-attracting group;

V2 and V4 each represents an electron-attracting group;

$R_{41}$, $R_{42}$, $R_{43}$ and $R_{44}$ may be the same or different and each represents an alkyl or alkenyl group having 10 or less carbon atoms in total, and at least one of $R_{41}$, $R_{42}$, $R_{43}$ and $R_{44}$ is a group having a sulfo group or a carboxyl group;

$X_4$ represents a counter ion necessary for neutralizing the charge of the molecule;

n represents 0 or 1, and when the molecule is an internal salt, n is 0.

As the electron-attracting group of V1, V2, V3 and V4, preferred are a halogen atom, a lower perfluoroalkyl group (preferably having 5 or less carbon atoms in total, such as trifluoromethyl, 2,2,2-trifluoroethyl, 2,2,3,3-tetrafluoropropyl), an acyl group (preferably having 8 or less carbon atoms in total, such as acetyl, propionyl, benzoyl, mesityl, benzenesulfonyl), an alkylsulfamoyl group (preferably having 5 or less carbon atoms in total, such as methylsulfamoyl, ethylsulfamoyl), a carboxyl group, an alkoxycarbonyl group (preferably having 5 or less carbon atoms in total, such as methoxycarbonyl, ethoxycarbonyl, butoxycarbonyl), and a cyano group.

The alkyl or alkenyl group of $R_{41}$, $R_{42}$, $R_{43}$ and $R_{44}$ preferably has 18 or less carbon atoms in total. As the substituents for the alkyl or alkenyl group, mentioned are, in addition to a sulfo group and a carboxyl group, a halogen atom (e.g., fluorine, chlorine, bromine), a hydroxyl group, an alkoxycarbonyl or aryloxycarbonyl group having 8 or less carbon atoms (e.g., methoxycarbonyl, ethoxycarbonyl, benzyloxycarbonyl, phenoxycarbonyl), a mono-cyclic aryloxy group having 10 or less carbon atoms (e.g., phenoxy, p-tolyloxy), an acyloxy group having 3 or less carbon atoms (e.g., acetyl, propionyl, benzoyl, mesyl), a carbamoyl group (e.g., carbamoyl, N, N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl), and an aryl group having 10 or less carbon atoms (e.g., phenyl, 4-chlorophenyl, 4-methylphenyl, α-naphthyl).

At least one of $R_{41}$, $R_{42}$, $R_{43}$ and $R_{44}$ is an alkyl or alkenyl group substituted by a sulfo group or a carboxyl group, more preferably a sulfoalkyl group. At least one of $R_{41}$, $R_{42}$, $R_{43}$ and $R_{44}$ is preferably an alkyl group substituted by an alkoxy group having 3 or less carbon atoms, more preferably a 2-methoxyethyl, 2-ethoxyethyl, 3-methoxypropyl or 3-ethoxypropyl group.

Specific examples of the sensitizing dyes of formula (IV) for use in the present invention are mentioned below, which, however, are not limitative.

IV-1

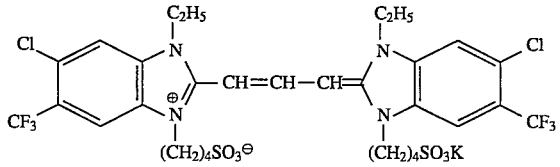

IV-2

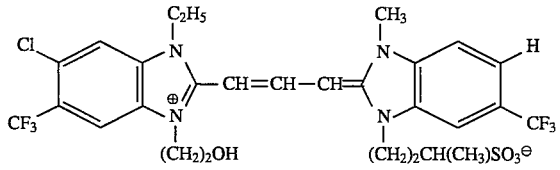

IV-3

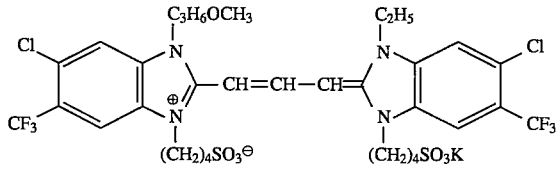

IV-4

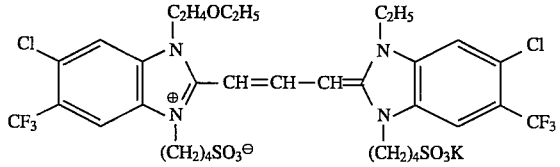

-continued
IV-5
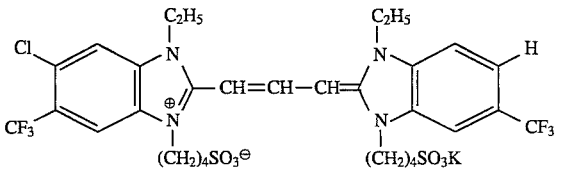
IV-6
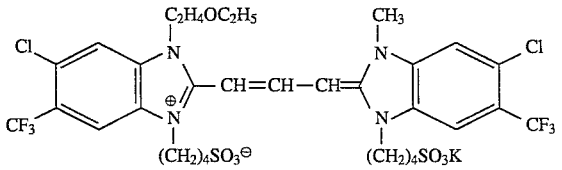
IV-7
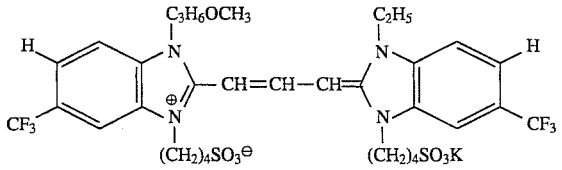
IV-8
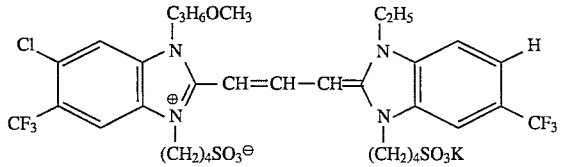
IV-9
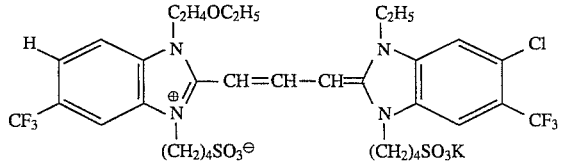
IV-10
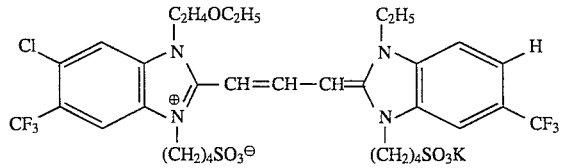
IV-11
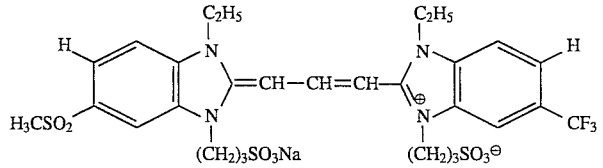
IV-12
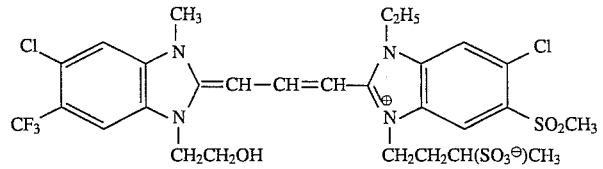
IV-13
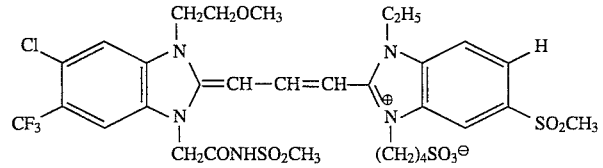

-continued

IV-14

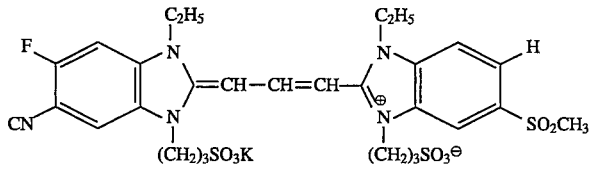

IV-15

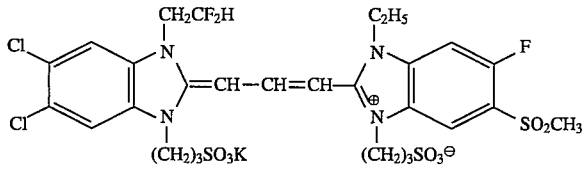

IV-16

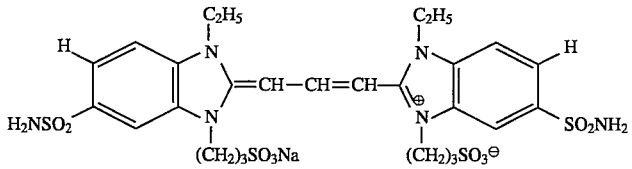

IV-17

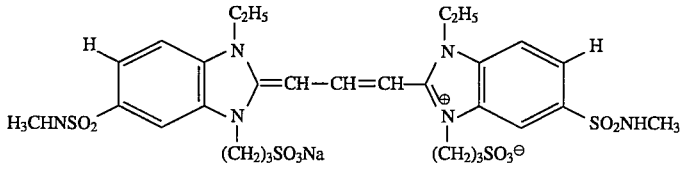

IV-18

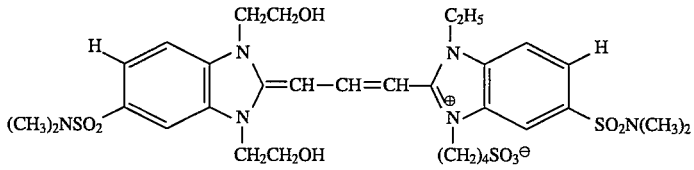

IV-19

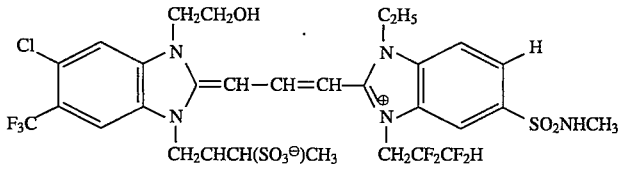

IV-20

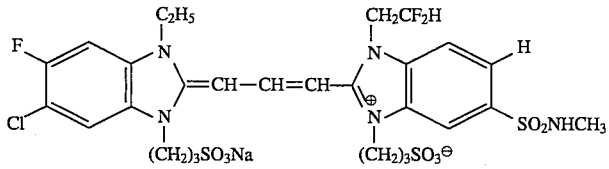

It is preferred that the above-mentioned dye as added to the photographic material of the present invention forms its aggregate therein. Of the above-mentioned sensitizing dyes, those of easily forming so-called J-aggregates are especially preferred. Addition of compounds capable of reinforcing the J-aggregates of the dyes, such as those described in JP-B-49-46932, JP-A-58-28738 and U.S. Pat. No. 3,776,738 (e.g., water-soluble bromides, bispyridinium salt compounds, mercapto-containing heterocyclic sulfonated compounds, alkali metal salts), along with the sensitizing dyes is preferred. These additional compounds are used in an amount of from $10^{-5}$ mol to one mol, per mol of silver halide.

The amount of the sensitizing dyes of formula (IV) to be added to the photographic emulsion of the present invention vary, depending upon the shapes and sizes of the silver halide grains in the emulsion. In general, it may be from $4\times10^{-6}$ to $8\times10^{-3}$ mol per mol of silver halide. For instance, when the size of the silver halide grains in the emulsion is from 0.2 to 1.3 μm, the amount is preferably from $2\times10^{-7}$ to $3.5\times10^{-6}$ mol, more preferably from $6.5\times10^{-7}$ to $2.0\times10^{-6}$ mol, per $m^2$ of the surfaces of the silver halide grains.

The light-sensitive silver halide emulsion of the present invention may optionally be color-sensitized additionally with other sensitizing dyes than the dyes of formula (IV) to be sensitive to blue light, green light, red light or infrared light having a relatively long wavelength. As such additional sensitizing dyes, usable are, for example, cyanine dyes, merocyanine dyes, complex cyanine dyes, complex merocyanine dyes, holopolar cyanine dyes, styryl dyes, hemicyanine dyes, oxonole dyes and hemioxonole dyes.

Sensitizing dyes which are usable in the present invention are described, for example, in *Research Disclosure,* Item 17643, IV-A (December, 1978, page 23), ibid., Item 1831X (August, 1978, page 437) and also in the references as referred to in them.

In particular, sensitizing dyes having a color sensitivity suitable for spectral characteristics of various scanner light sources are advantageously selected so as to use them in the present invention.

For instance, (A) simple merocyanines such as those described in JP-A-60-162247, 2-48653, and 5-11389, U.S. Pat. No. 2,161,331, German Patent 936,071 are advantageously selected for argon laser rays; (B) trinuclear cyanine dyes such as those described in JP-A-50-62425, 54-18726 and 59-102229 for helium-neon laser rays; (C) thiacarbocyanines such as those described in JP-B-48-42172, 51-9609, 55-39818, 62-284343 and 2-105135 for LED light sources and red semiconductor lasers; and (D) tricarbocyanines such as those described in JP-A-59-191032 and 60-80841 and 4-quinoline nucleus-having dicarbocyanines such as those of formulae (IIIa) and (IIIb) described in JP-A-59-192242 and 3-67242 for infrared semiconductor laser rays.

These sensitizing dyes may be used singly or as a combination of them. The combination of such sensitizing dyes is often employed for supersensitization. The emulsion of the present invention may contain dyes which do not have a color-sensitizing effect by themselves or substances which do not substantially absorb visible rays but have a supersensitizing effect, along with the sensitizing dyes.

Useful sensitizing dyes, combinations of sensitizing dyes for supersensitization and supersensitizing substances are described in *Research Disclosure,* Vol. 176, Item 17643 (December, 1978), IV-J (page 23).

It is desired that the optimum amount of the sensitizing dye to be incorporated into the photographic emulsion of the present invention is selected in accordance with the grain size and the halogen composition of the silver halide grains in the emulsion, the method for chemical sensitization of the emulsion, the degree of the chemical sensitization, the relation between the layer to which the dye is added and the silver halide emulsion layer and the kind of the anti-fogging compound to be added. Test methods for the selection are well known by those skilled in the art. In general, the amount of the sensitizing dye to be added is preferably from $10^{-7}$ mol to $1\times10^{-2}$ mol, especially preferably from $10^{-6}$ to $5\times10^{-3}$ mol, per mol of silver halide.

For argon laser rays, the following dyes are especially preferably used.

V-1

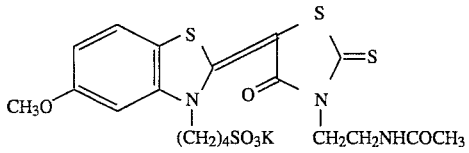

V-2

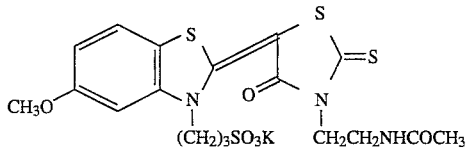

-continued

V-3

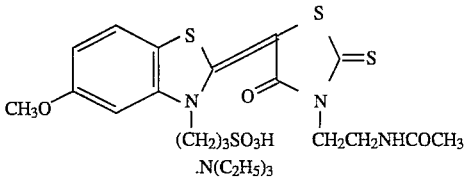

V-4

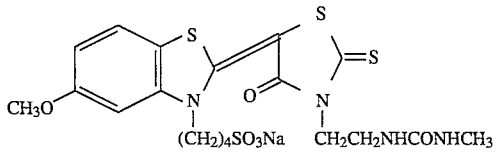

V-5

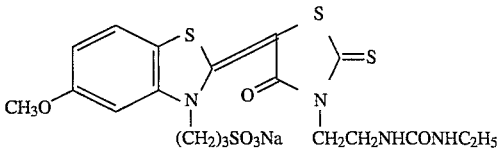

V-6

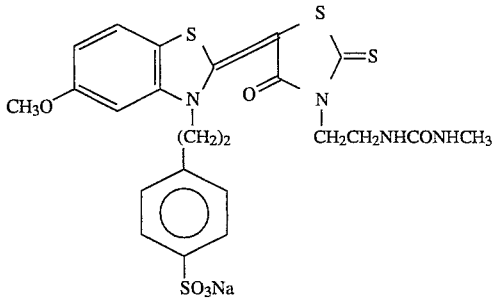

V-7

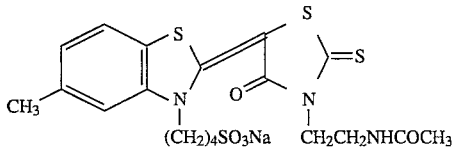

V-8

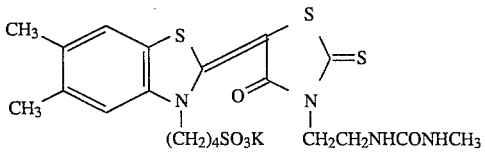

V-9

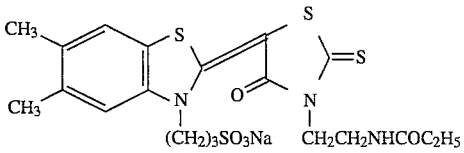

-continued

V-10

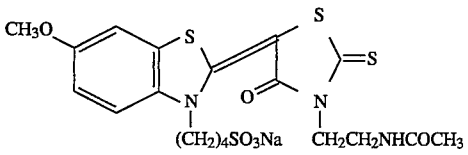

V-11

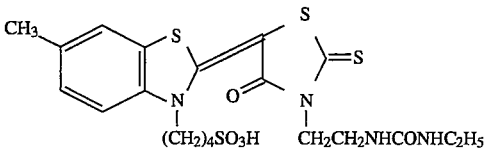

V-12

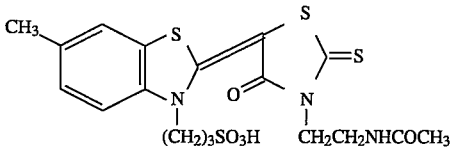

-continued

V-13

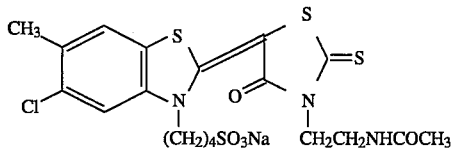

For helium-neon rays, sensitizing dyes of formula (I) described in Japanese Patent Application No. 4-228745, from page 8, line 1 from below to page 13, line 4 are especially preferred, in addition to the above-mentioned dyes. As specific examples of such dyes, Compounds (VI-1) to (VI-8) are mentioned below. In addition to these, compounds of formula (I) described in Japanese Patent Application No. 4-228745 are also preferred.

VI-1

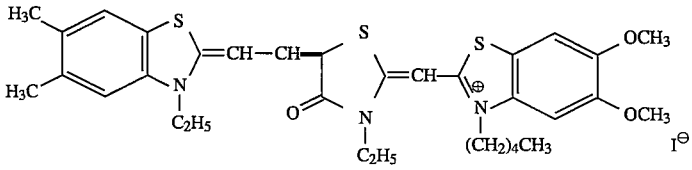

VI-2

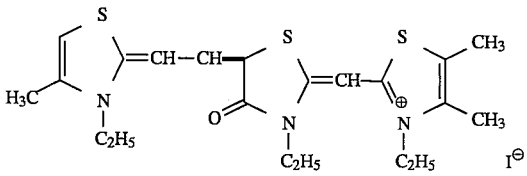

VI-3

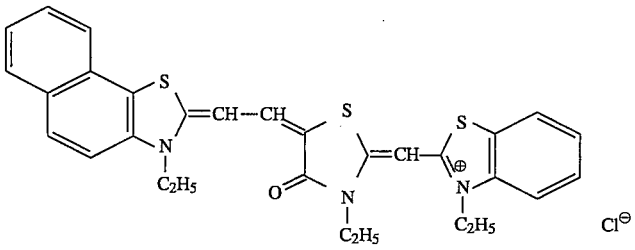

VI-4

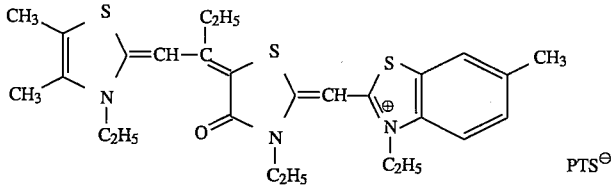

-continued
VI-5
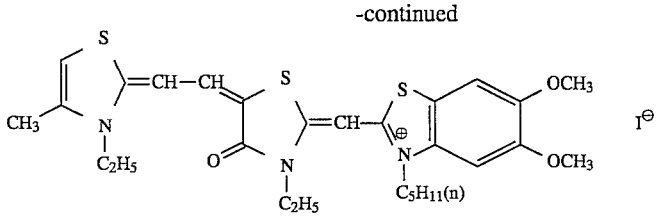
VI-6
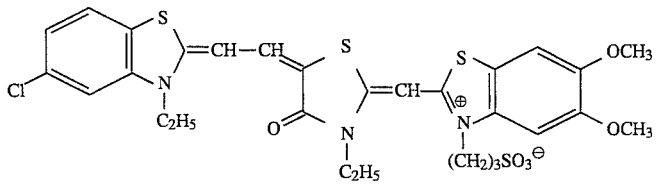
VI-7
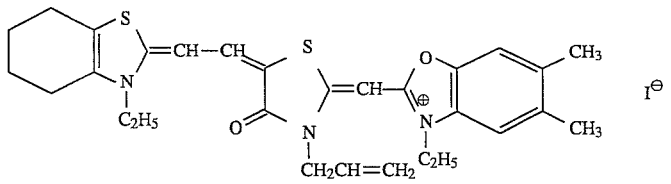
VI-8
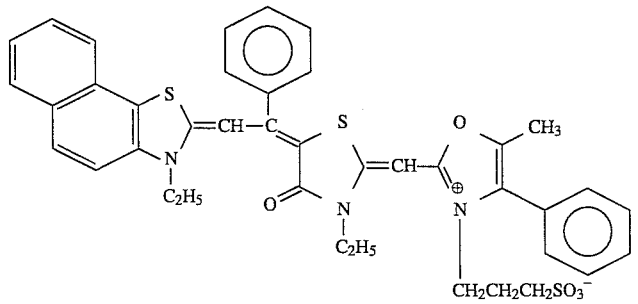
For LED ray sources and red semiconductor lasers, the following dyes are especially preferred.
VII-1
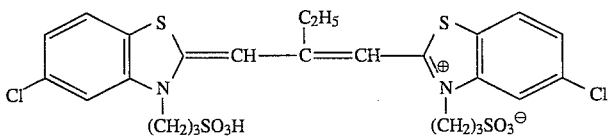

-continued
VII-2
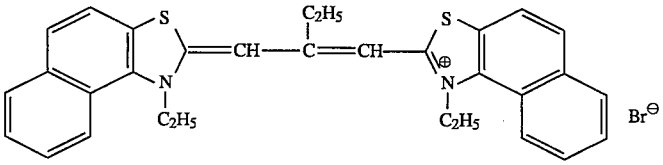
VII-3
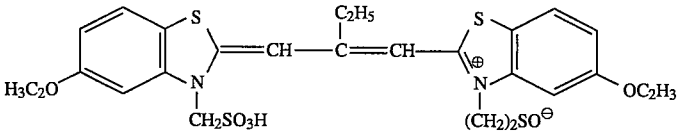
VII-4
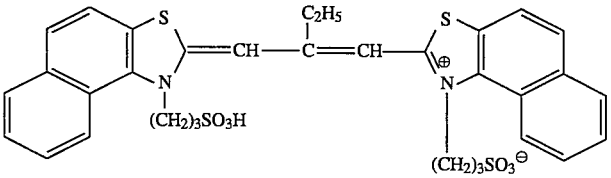
VII-5
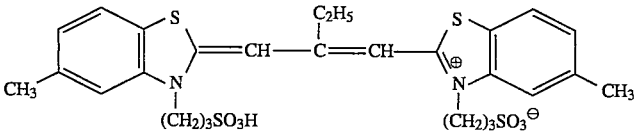
VII-6
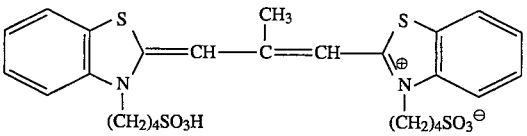
VII-7
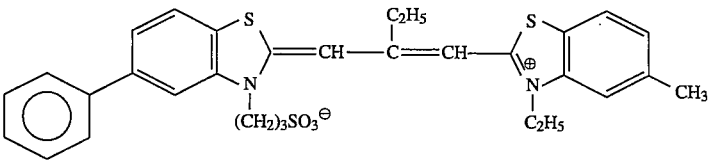
VII-8
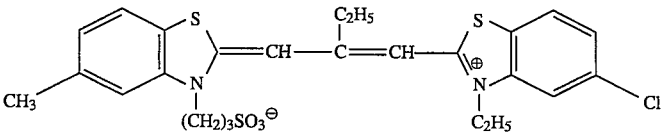
For infrared semiconductor laser rays, the following dyes are especially preferred:

VIII-1
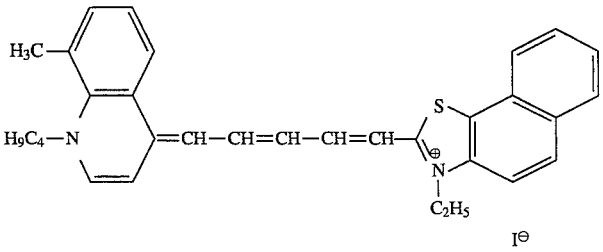
VIII-2
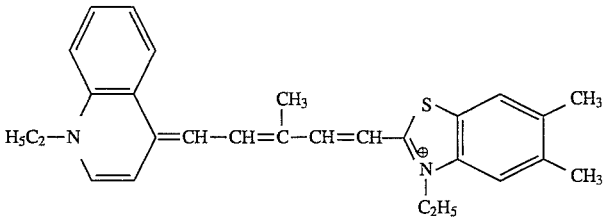
VIII-3
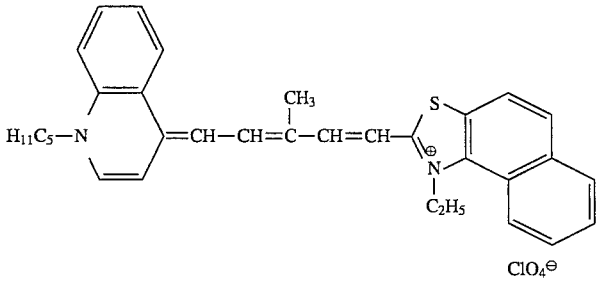
VIII-4
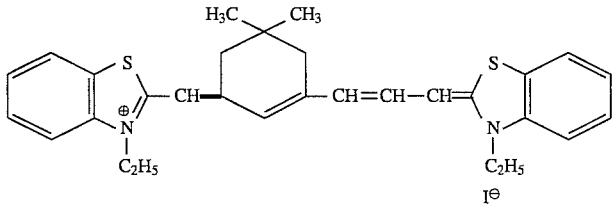
VIII-5
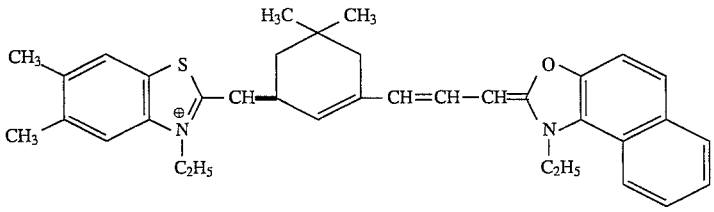
VIII-6
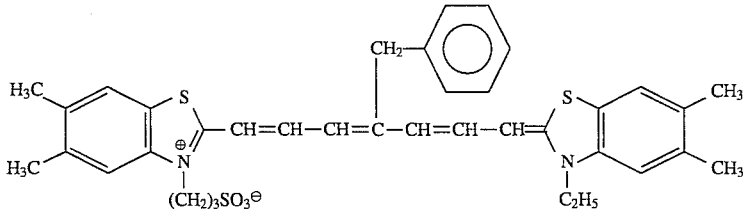

-continued

VIII-7

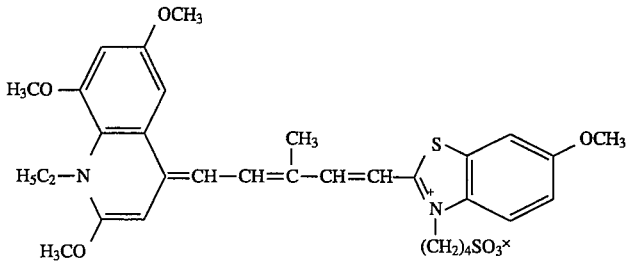

VIII-8

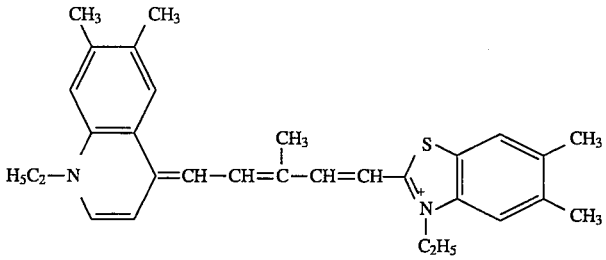

VIII-9

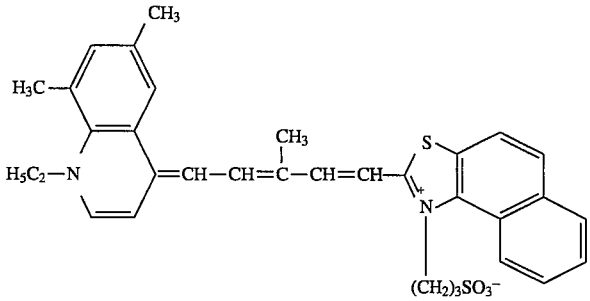

The halogen composition of the silver halide emulsion for use in the present invention is preferably silver chloride, silver chlorobromide or silver chloroiodobromide having a silver chloride content of 50 mol % or more, in order to more effectively attain the objects of the present invention. It is preferred that the silver iodide content in the halogen composition is lower than 5 mol %, especially preferably lower than 2 mol %.

The photographic emulsions to be used in the present invention may be prepared by known methods, for example, by the methods described in P. Glafkides, *Chimie et Physique Photographique* (published by Paul Montel, 1967), G. F. Duffin, *Photographic Emulsion Chemistry* (published by The Focal Press, 1966) and V. L. Zelikman et al, *Making and Coating Photographic Emulsions* (published by The Focal Press, 1964).

For reacting a soluble silver salt and soluble halides for making the silver halide grains of the present invention, a single jet method, a double jet method or a combination of them may be employed.

A so-called reversed mixing method of forming silver halide grains in the presence of excess silver ions may also be employed. As one system of a double jet method, a so-called controlled double jet method where the pAg in the liquid phase of forming silver halide grains therein is kept constant may also be employed. Preferred is to form the silver halide grains in the presence of a so-called silver halide solvent such as ammonia, thioethers or tetra-substituted thioureas. Especially preferred as the silver halide solvent are tetra-substituted thiourea compounds, which are described in, for example, JP-A-53-82408 and 55-77737. Of them, preferred are tetramethyl-thiourea and 1,3-dimethyl-2-imidazolidinethione.

By the controlled double jet method and the method of forming grains using the silver halide solvent, formation of silver halide grains of regular crystals having a narrow grain size distribution is easy. Therefore, the methods are useful for forming the silver halide emulsions for use in the present invention.

For making the grain size of the silver halide grains uniform, a method of varying the speeds of adding silver nitrate and alkali halides in accordance with the speed of the growth of the grains being formed, such as that as described in British Patent 1,535,016 and JP-B-48-36890 and 52-16364, and a method of varying the concentrations of the aqueous solutions to be reacted, such as that described in U.S. Pat. No. 4,242,445 and JP-A-55-158124, are preferably employed whereby the grains are grown rapidly within the range of not overstepping the critical saturations.

The silver halide photographic material of the present invention preferably contains a rhodium compound so as to have a high contrast and so as not to be fogged.

The rhodium compound to be used in the present invention is preferably a water-soluble rhodium compound. For instance, usable are rhodium(III) halides, as well as rhodium complexes having halogen, amine, oxalato or the like ligands, such as hexachloro-rhodium(III) complex, hexabromo-rhodium(III) complex, hexaammine-rhodium(III) complex, trioxalato-rhodium(III) complex, etc. These rhodium compounds are used as solutions of them in water or in suitable solvents. For stabilizing the rhodium compound solutions, an aqueous hydrogen halide solution (e.g., hydrochloric acid, hydrobromic acid, hydrofluoric acid) or an alkali halide (e.g., KCl, NaCl, KBr, NaBr) may be added thereto, as well known for the purpose. In place of using the water-soluble rhodium compounds, different rhodium-doped silver halide grains may be added to the system of forming the silver halide emulsion of the present invention, whereupon the rhodium is liberated from the grains into the system.

The total amount of the rhodium compound to be in the silver halide emulsion of the present invention is suitably from $1\times10^{-8}$ to $5\times10^{-6}$, preferably from $5\times10^{-8}$ to $1\times10^{-6}$ mol, per mol of the silver halide to be finally formed.

The addition of these compounds to the emulsion may be conducted at any stage during the formation of the silver halide grains and before the coating of the emulsion. Especially preferably, the compound is added during the formation of the emulsion whereby it is incorporated into the silver halide grains formed.

The silver halide photographic material of the present invention preferably contains an iridium compound so as to have a high sensitivity and a high contrast.

Various iridium compounds may be employed in the present invention. For instance, mentioned are hexachloroiridium, hexaammine-iridium, trioxalato-iridium, hexacyano-iridium, etc. These iridium compounds are used as solutions of them in water or in suitable solvents. For stabilizing the iridium compound solutions, an aqueous hydrogen halide solution (e.g., hydrochloric acid, hydrobromic acid, hydrofluoric acid) or an alkali halide (e.g., KCl, NaCl, KBr, NaBr) may be added thereto, as well known for the purpose. In place of using the water-soluble iridium compounds, different iridium-doped silver halide grains may be added to the system of forming the silver halide emulsion of the present invention, whereupon the iridium is liberated from the grains into the system.

The total amount of the iridium compound to be in the silver halide emulsion of the present invention is suitably from $1\times10^{-8}$ to $5\times10^{-6}$, preferably from $5\times10^{-8}$ to $1\times10^{-6}$ mol, per mol of the silver halide to be finally formed.

The addition of the compound to the emulsion may be conducted at any stage during the formation of the silver halide grains and before the coating of the emulsion. Especially preferably, the compound is added during the formation of the emulsion whereby it is incorporated into the silver halide grains formed.

The silver halide grains for use in the present invention may contain metal atoms such as iron, cobalt, nickel, ruthenium, palladium, .platinum, gold, thallium, copper, lead, osmium, etc. The amount of the metal to be added is preferably from $1\times10^{-9}$ to $1\times10^{-4}$ mol, per mol of silver halide. For incorporating the metal into the silver halide grains, salts of the metal, such as simple salts, double salts or complex salts thereof, may be added thereto during the formation of the grains.

The silver halide emulsion of the present invention is preferably chemical-sensitized. For the chemical sensitization of the emulsion, employable are known sulfur sensitization method, selenium sensitization method, tellurium sensitization method and noble metal sensitization method. The methods may be employed singly or as a combination thereof. In the latter case, for instance, preferred are a combination of sulfur sensitization and gold sensitization methods, a combination of sulfur sensitization, selenium sensitization and gold sensitization methods, and a combination of sulfur sensitization, tellurium sensitization and gold sensitization methods.

The sulfur sensitization of the emulsion of the present invention may be conducted, in general, by adding a sulfur sensitizing agent to the emulsion followed by stirring the emulsion at a high temperature of 40° C. or higher for a determined period of time. As the sulfur sensitizing agent, any known sulfur compound may be used. For instance, usable are sulfur compounds to be contained in gelatin, as well as other various sulfur compounds such as thiosulfates, thioureas, thiazoles, rhodanines, etc. Of them, preferred are thiosulfates and thiourea compounds. The amount of the sulfur sensitizing agent to be added varies, depending upon various conditions such as, for example, the pH and temperature conditions for the chemical ripening and the size of the silver halide grains being ripened. In general, however, it is from $10^{-7}$ to $10^{-2}$ mol, more preferably from $10^{-5}$ to $10^{-3}$ mol, per mol of silver halide.

The selenium sensitizing agent for use in the present invention may be any known selenium compound. In general, for instance, for conducting the selenium sensitization, unstabilized and/or non-unstabilized selenium compounds are added to the emulsion, which is then stirred at a high temperature of 40° C. or higher for a determined period of time. As the unstabilized selenium compounds, for example, those described in JP-B-44-15748 and 43-13489 and in JP-A-4-25832, 4-109240, 4-324855 can be used. In particular, the compounds of formulae (VIII) and (IX) described in JP-A-4-324855 are preferred.

The tellurium sensitizing agent for use in the present invention is a compound capable of forming a silver telluride, which is presumed to be sensitizing nuclei on the surfaces of the silver halide grains or in the inside of them. The speed of forming the silver telluride in the silver halide emulsion being sensitized may be tested by the method described in Japanese Patent Application No. 4-146739.

As examples of the tellurium sensitizing agent for use in the present invention, mentioned are compounds as described in U.S. Pat. Nos. 1,623,499, 3,320,069, 3,772,031; British Patents 235,211, 1,121,496, 1,295,462, 1,396,696; Canadian Patent 800,958; JP-A-4-204640, 4-271341, 4-333043 and Japanese Patent Application No. 4-129787; *J. Chem. Soc. Chem. Commun.*, 635 (1980); ibid., 1102 (1978); ibid., 645 (1979); *J. Chem. Soc. Perkin, Trans.*, 1, 2191 (1980); S patai, *The Chemistry of Organic Selenium and Tellurium Compounds,* Vol. 11 (1986); ibid., Vol. 2 (1987), etc. In particular, the compounds of general formula (II), (III) and (IV) described in Japanese Patent Application No. 4-146739 are preferred.

The amounts of the selenium and tellurium sensitizing agents to be used in the present invention vary, depending upon the silver halide grains to be sensitized therewith and the chemical ripening conditions. In general, they are approximately from $10^{-8}$ to $10^{-2}$ mol, preferably approximately from $10^{-7}$ to $10^{-3}$ mol, per mol of silver halide. The conditions for the chemical sensitization of the silver halide grains of the present invention are not specifically limited. Preferably, the pH is from 5 to 8; the pAg is from 6 to 11, preferably from 7 to 10; and the temperature is from 40° to 95° C., preferably from 45° to 85° C.

As the noble metal sensitizing agent for use in the present invention, mentioned are, for example, gold, platinum, palladium, iridium and the like compounds. Especially preferred is gold sensitization. As examples of the gold sensitizing agent to be used, mentioned are chloroauric acid, potassium aurate, potassium aureothiocyanate, gold sulfide, etc. The agent may be added in an amount of approximately from $10^{-7}$ to $10^{-2}$ mol per mol of silver halide.

The silver halide emulsion of the present invention may be formed in the presence of a cadmium salt, a sulfite, a lead salt, a thallium salt or the like during the formation of the silver halide grains or during the physical ripening thereof.

Reduction sensitization may be employed in the present invention. As the usable reduction-sensitizing agent, mentioned are, for example, stannous salts, amines, formamidinesulfinic acids, silane compounds, etc.

The silver halide emulsion of the present invention may contain a thiosulfonic acid compound in accordance with the method described in EP 293,917.

The photographic material of the present invention may comprise one silver halide emulsion or two or more different silver halide emulsions having different mean grain sizes, different halogen compositions and/or different crystal habits and/or having been chemical-sensitized by different conditions.

As a binder or a protective colloid in photographic emulsions of constituting the photographic material of the present invention, gelatin is advantageously used. Additionally, any other hydrophilic colloids may also be used. For instance, usable are proteins such as gelatin derivatives, graft polymers of gelatin and other polymers, albumin and casein; cellulose derivatives such as hydroxyethyl cellulose, carboxymethyl cellulose and cellulose sulfates; saccharide derivatives such as sodium alginate and starch derivatives; as well as other various synthetic hydrophilic homopolymers or copolymers such as polyvinyl alcohol, polyacrylic acid, polymethacrylic acid, polyacrylamide, polyvinylimidazole and polyvinyl butyral.

In order to obtain ultra-hard photographic images with high sensitivity, using the silver halide photographic material of the present invention, it is unnecessary to use a conventional infectious developer or a high alkali developer having a pH value of about 13 as described in U.S. Pat. No. 2,419,975, but any and every stable developer can be used.

Precisely, the silver halide photographic material of the present invention can well be processed with a developer containing, as a preservative, sulfite ions in an amount of 0.15 mol/liter or more and having a pH value of from 9.6 to 11.0 to give a sufficiently ultra-hard negative image.

The developing agent to be in the developer which is used the photographic material of the present invention is not specifically defined, but the developer is desired to contain dihydroxybenzenes in order to easily form hard images having a good dot quality. As the case may be, a combination of dihydroxybenzenes and 1-phenyl-3-pyrazolidones , or a combination of dihydroxybenzenes and p-aminophenols may also be employed.

As examples of dihydroxybenzene developing agents usable for processing the photographic materials of the present invention, there are mentioned hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Especially preferred is hydroquinone.

1-Phenyl-3-pyrazolidone and derivatives thereof may also be used as a developing agent in the present invention. Examples thereof include 1-phenyl-3-pyrazolidone, 1-phenyl-4,4-dimethyl-4-pyrazolidone, 1-phenyl-4-methyl-4-hydroxymethyl-3-pyrazolidone, 1-phenyl4,4-dihydroxymethyl-3-pyrazolidone, 1-phenyl-5-methyl-3pyrazolidone, 1-p-aminophenyl-4,4-dimethyl-3-pyrazolidone, and 1-p-tolyl-4,4-dimethyl-3-pyrazolidone.

As examples of p-aminophenol developing agents also usable in the present invention, there are mentioned N-methyl-p-aminophenol, p-aminophenol, N-(β-hydroxyethyl)-p-aminophenol, N-(4-hydroxyphenyl)glycine, 2-methyl-paminophenol, and p-benzylaminophenol. Above all, preferred is N-methyl-p-aminophenol.

The amount of the developing agent to be in the developer for use in the present invention is generally preferably from 0.05 mol/liter to 0.8 mol/liter. Where a combination of dihydroxybenzenes and 1-phenyl-3-pyrazolidones or p-aminophenols is employed, it is preferred that the content of the former in the developer is from 0.05 mol/liter to 0.5 mol/liter and that of the latter therein is 0.06 mol/liter or less.

The developer for use in the present invention can contain, as a preservative, a sulfite such as sodium sulfite, potassium sulfite, lithium sulfite, ammonium sulfite, sodium bisulfite, potassium metabisulfite or formaldehyde-sodium bisulfite. The content of such a sulfite is preferably 0.15 mol/liter or more, especially preferably 0.3 mol/liter or more. The upper limit of the sulfite content is desirably up to 2.5 mol/liter.

The developer may contain an alkali agent for the purpose of properly adjusting the pH value thereof. As such an alkali agent, usable is a pH adjusting agent or a pH buffer, such as sodium hydroxide, potassium hydroxide, sodium carbonate, potassium carbonate, sodium tertiary phosphate, or potassium tertiary phosphate. The pH value of the developer is accordingly adjusted to fall between 9.6 and 11.0.

The developer may further contain any other additives than the above-mentioned components. Such additives include, for example, a development inhibitor such as boric acid, borax, sodium bromide, potassium bromide or potassium iodide; an organic solvent such as ethylene glycol, diethylene glycol, triethylene glycol, dimethylformamide, methyl cellosolve, hexylene glycol, ethanol or methanol; an antifoggant or black pepper inhibitor such as indazole compounds (e.g., 1-phenyl-5-mercaptotetrazole, 5-nitroindazole) or benzotriazole compounds (e.g., 5-methylbenzotriazole); and optionally a color toning agent, a surfactant, a defoaming agent, a water softener, a hardening agent, and amino compounds described in JP-A-6-106244.

The developer for use in the present invention can contain, as a silver stain inhibitor, compounds described in JP-A-56-24347. As a dissolution aid to be added to the developer, compounds described in JP-A-61-267759 can be used. Additionally, as a pH buffer to be added to the developer, compounds described in JP-A-60-93433 and 62-186259 can also be used.

As a fixing agent to be used in processing the developed photographic materials of the present invention, any and every conventional one can be used. For instance, thiosulfates and thiocyanates and other organic sulfur compounds which are known effective as a fixing agent can be used. The fixer to be used in the present invention can contain, as a hardening agent, a water-soluble aluminium compound (e.g., aluminium sulfate, alum). The amount of the water-soluble aluminium salt to be in the fixer may be generally from 0.4 to 2.0 g(Al)/liter. Additionally, the fixer may also contain, as an oxidizing agent, a ferric compound, such as an ethylenediaminetetraacetate/ferric complex.

The development temperature is selected from the range between 18° C. and 50° C, more preferably between 25° C. and 43° C.

Additives which may be added to the photographic material of the present invention are not specifically defined. For instance, the following additives are preferably used in the present invention.

| Additives | References |
|---|---|
| 1) Color | Color sensitizing dyes described in |

-continued

| Additives | References |
|---|---|
| Sensitizing Dyes | JP-A 2-12236, column 8, from left bottom column, line 13 to right bottom column, line 4; JP-A 2-103536, from page 16, right bottom column, line 3 to page 17, left bottom column, line 20; JP-A-1-112235, 2-124560, 3-7928; JP-A-5-11389 Japanese Patent Application No. 3-411064 |
| 2) Surfactant | Compounds described in JP-A-2-12236, page 9, from right top column, line 7 to right bottom column, line 7; Compounds described in JP-A-2-18542, from page 2, left bottom column, line 13 to page 4, right bottom column, line 18 |
| 3) Antifoggant | Compounds described in JP-A-2-103536, from page 17, right bottom column, line 19 to page 18, right top column, line 4, and page 18, right bottom column, lines 1 to 5; Thiosulfinic acid compound described in JP-A-1-237538 |
| 4) Polymer latex | Compounds described in JP-A-2-103536, page 18, left bottom column, lines 12 to 20 |
| 5) Acid group-having compound | Compounds described in JP-A-2-103536, from page 18, right bottom column, line 6 to page 19, left top column, line 1 |
| 6) Mat agent; Lubricant; Plasticizer | Compounds described in JP-A-2-103536, page 19, from left top column, line 15 to right top column, line 15 |
| 7) Hardening agent | Compounds described in JP-A-2-103536, page 18, right top column, lines 5 to 17 |
| 8) Dye | Dyes described in JP-A-2-103536, page 17, right bottom column, lines 1 to 18; Solid dyes described in JP-A 2-294638 and 5-11382 |
| 9) Binder | Compounds described in JP-A-2-18542, page 3, right bottom column, lines 1 to 20 |
| 10) Black pepper inhibiting agent | Compounds described in U.S. Patent 4,956,257 Compounds described in JP-A-1-118832 |
| 11) Redox compound | Compounds of formula (I) (especially, Compound Nos. 1 to 50) described in JP-A 2-301743; Compounds of formulae (R-1), (R-2) and (R-3) and Compound Nos. 1 to 75 described in JP-A-3-174143, pages 3 to 20; Compounds described in Japanese Patent Application Nos. 3-69466 and 3-15648 |
| 12) Monomethine compound | Compounds of formula (II) (especially, Compounds II-1 to II-26) described in JP-A-2-287532 |
| 13) Dihydroxybenzene compound | Compounds described in JP-A-3-39948, from page 11, left top column to page 12, left bottom column; Compounds described in EP 452,772A |

The present invention will be explained in more detail by means of the following examples, which, however, are not intended to restrict the scope of the present invention. Unless otherwise indicated, all parts, percents and ratios are by weight.

Preparation of Silver Halide Emulsions:

Emulsion (A):

An aqueous silver nitrate solution, $1.0\times10^{-7}$ mol, per mol of silver in the finished emulsion, of $(NH_4)_3RhCl_6$, $2\times10^{-7}$ mol, per mol of the same, of $K_3IrCl_6$, and an aqueous halide solution containing potassium bromide and sodium chloride were added to an aqueous gelatin solution containing sodium chloride and 1,3-dimethyl-2-imidazolidinethione, by a double jet method with stirring, to form silver chlorobromide grains having a mean grain size of 0.20 μm and a silver chloride content of 60 mol % by nucleation. Subsequently, an aqueous silver nitrate solution and an aqueous halide solution containing potassium bromide and sodium chloride were added thereto by the same double jet method. Afterwards, $1\times10^{-3}$ mol, per mol of silver, of a KI solution was added thereto for halogen-conversion, and the resulting emulsion was washed with water by conventional flocculation. Gelatin was added thereto, and the resulting emulsion was adjusted to have pH of 6.5 and pAg of 7.5. 7 mg, per mol of silver, of sodium benzenethiosulfonate, 5 mg, per mol of the same, of sodium thiosulfate and 8 mg, per mol of the same, of chloroauric acid were added to the emulsion for chemical sensitization. As a stabilizer, 150 mg of 4-hydroxy-6-methyl-1,3,3a,7-tetrazaindene was added thereto. In addition, Proxel was added thereto as an antiseptic. The grains thus formed were cubic silver chlorobromide grains having a mean grain size of 0.28 μm and a silver chloride content of 60 mol %. The emulsion had a grain size fluctuation coefficient of 9%.

Emulsion (B):

Emulsion (B) was prepared in the same manner as in preparation of Emulsion (A), except that the proportions of potassium bromide and sodium chloride were varied. This contained cubic silver chlorobromide grains having a silver chloride content of 30 mol %.

Emulsion (C):

An aqueous silver nitrate solution, $1.0\times10^{-7}$ mol, per mol of silver in the finished emulsion, of $(NH_4)_3RhCl_6$, $2\times10^{-7}$ mol, per mol of the same, of $K_3IrCl_6$, and an aqueous halide solution containing potassium bromide and potassium iodide were added to an aqueous gelatin solution containing 1,3-dimethyl-2-imidazolidinethione, by a double jet method with stirring at pAg of 7.8, to form silver iodobromide grains having a mean grain size of 0.20 μm and a silver chloride content of 60 mol % by nucleation. Subsequently, an aqueous silver nitrate solution and an aqueous halide solution containing potassium bromide and potassium iodide were added thereto by the same double jet method at pAg of 7.8. Afterwards, $1\times10^{-3}$ mol, per mol of silver, of a KI solution was added thereto for halogen-conversion, and the resulting emulsion was washed with water by conventional flocculation. Gelatin was added thereto, and the resulting emulsion was adjusted to have pH of 6.5 and pAg of 7.5. 7 mg, per mol of silver, of sodium benzenethiosulfonate, 5 mg, per mol of the same, of sodium thiosulfate and 8 mg, per mol of the same, of chloroauric acid were added to the emulsion for chemical sensitization. As a stabilizer, 150 mg of 4-hydroxy-6-methyl-1,3,3a,7-tetrazaindene was added thereto. In addition, Proxel was added thereto as an antiseptic. The grains thus formed were cubic silver iodobromide grains having a mean grain size of 0.28 μm and a silver bromide content of 98 mol %. The emulsion had a grain size fluctuation coefficient of 8%.

EXAMPLE 1

Preparation of Coated Photographic Material Samples:

Emulsion Layer:

Each of the thus-prepared silver halide emulsions was dissolved in gelatin at 40° C., and $4.0\times10^{-4}$ mol, per mol of Ag, of a sensitizing dye of the above-mentioned Compound (IV-9) was added thereto. Next, $1.0\times10^{-5}$ mol/m$^2$ of the following Compound (a), $5.0\times10^{-6}$ mol/m$^2$ of the following Compound (b), $7.0\times10^{-6}$ mol/m$^2$ of the following Compound (c), 40 mg/m$^2$ of hydroquinone, $6.4\times10^{-4}$ mol, per mol of Ag, of the hydrazine derivative of formula (I) as indicated in Table 1 below, the compound of formula (II) or Comparative Compound (B-1) to (B-6) as indicated in Table 1, 6 mg/m$^2$ of sodium dodecylbenzenesulfonate, 2 mg/m$^2$ of the following Compound (d), 500 mg/m$^2$ of a water-soluble latex of the following Compound (e), 300 mg/m$^2$ of latex copolymer comprising methyl acrylate, sodium 2-acrylamido-2-methylpropanesulfonate and acetoacetoxyethyl methacrylate (88/5/7, by weight), 3 % by weight, relative to gelatin, of a hardening agent of the following Compound (f), and 1 % by weight, relative to gelatin, of bis-vinylsulfonylmethane were added thereto. The coating liquid thus prepared was adjusted to have pH of 5.8. This was coated on a polyethylene terephthalate film support (thickness: 150 μm) having thereon a subbing layer (thickness: 0.5 μm) of a vinylidene chloride copolymer, the amount of silver coated being 3.2 g/m$^2$ and the amount of gelatin coated being 2.0 g/m$^2$.

(a)

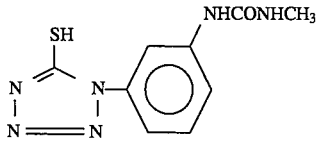

(b)

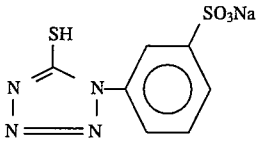

(c)

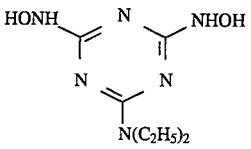

(d)

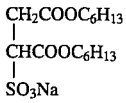

(e)

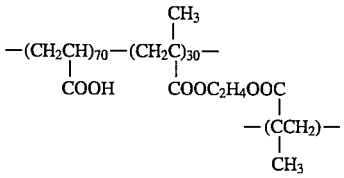

(f)

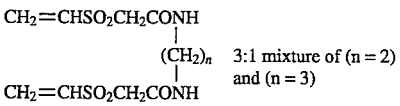

3:1 mixture of (n = 2) and (n = 3)

-continued (g)

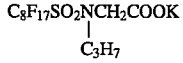

Protective Layer:

Over the emulsion layer thus coated, coated was a protective layer comprising 1.0 g/m$^2$ of gelatin, 40 mg/m$^2$ of amorphous $SiO_2$ mat agent having a mean grain size of 3.5 μm, 0.1 g/m$^2$ of methanol silica, 100 mg/m$^2$ of polyacrylamide, 150 mg/m$^2$ of hydroquinone, 20 mg/m$^2$ of silicone oil, and, as coating aids, 5 mg/m$^2$ of the the above-mentioned Compound (g) and 25 mg/m$^2$ of sodium dodecylbenzenesulfonate. Hence, coated photographic material samples as shown in Table 1 were prepared.

The samples each had the following backing layer and backing layer-protecting layer.

| Composition of Backing Layer: | |
|---|---|
| Gelatin | 3 g/m$^2$ |
| Polyethyl Acrylate Latex | 2 g/m$^2$ |
| Sodium P-dodecylbenzenesulfonate | 40 mg/m$^2$ |
| Compound (f) | 3% by weight, relative to gelatin |
| Dye (a) | 50 mg/m$^2$ |
| Dye (b) | 100 mg/m$^2$ |
| Dye (c) | 50 mg/m$^2$ |
| $SnO_2$/Sb (90/10; mean grain size 0.20 μm) | 200 mg/m$^2$ |
| **Composition of Backing Protecting Layer:** | |
| Gelatin | 0.8 mg/m$^2$ |
| Fine Polymethyl Methacrylate Grains (mean grain size 4.5 μm) | 30 mg/m$^2$ |
| Sodium Dihexyl-α-sulfosuccinate | 15 mg/m$^2$ |
| Sodium P-Dodecylbenzenesulfonate | 15 mg/m$^2$ |
| Sodium Acetate | 40 mg/m$^2$ |

Dye (a):

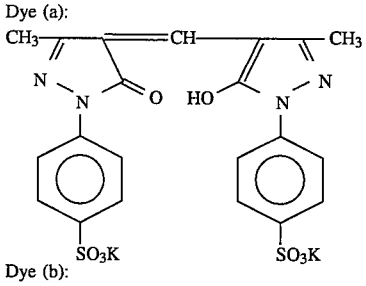

Dye (b):

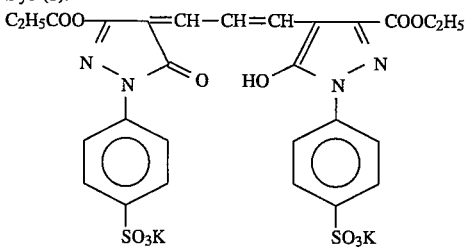

-continued

Dye (c):

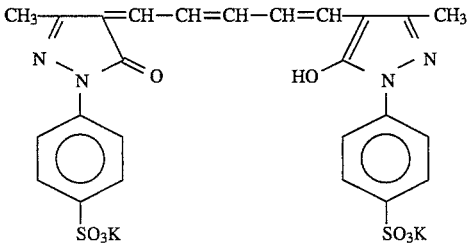

The following developers were used for processing the samples.

| Compositions of Developers: | | |
|---|---|---|
| Components | (A) | (B) |
| Potassium Hydroxide | 35.0 g | 35.0 g |
| Diethylenetriamine-pentaacetic Acid | 2.0 g | 2.0 g |
| Sodium Metabisulfite | 40.0 g | 40.0 g |
| Potassium Carbonate | 12.0 g | 12.0 g |
| Potassium Bromide | 3.0 g | 3.0 g |
| 5-Methylbenzotriazole | 0.06 g | 0.06 g |
| 2,3,5,6,7,8-Hexahydro-2-thioxo-4(1H)-quinazolinone | 0.04 g | 0.04 g |
| Sodium 2-mercaptobenzimidazol-5-sulfonate | 0.15 g | 0.15 g |
| Hydroquinone | 25.0 g | 25.0 g |
| 4-Hydroxymethyl-4-methyl-1-phenyl-3-pyrazolinone | 0.45 g | 0.45 g |
| Sodium Erysorbate | 3.00 g | 3.00 g |
| Water to make | 1 liter | 1 liter |
| pH (adjusted to) | 10.5 | 10.8 |

The samples were processed in the manner mentioned below, and the photographic properties of the processed samples were evaluated in the manner mentioned below.

Fresh Processing:

Using a tungsten sensitometer, each sample was exposed through a filter having a color temperature of 3200° K. and a step wedge. The exposed samples were then developed, using an automatic developing machine FG-460A Model (manufactured by Fuji Photo Film Co.), with Developer (A) at 35° C. for 30 seconds, fixed, rinsed and dried. As the fixer, used was GR-F1 (produced by Fuji Photo Film Co.).

Evaluation of Photographic Properties of Processed Samples:

1. γ=(gradation):

γ=(optical density (3.0—0.3))ΔlogE where ΔlogE means the difference between the exposure amount necessary for giving an optical density of 3.0 (logE 3.0) and the exposure amount necessary for giving an optical density of 0.3 (logE 0.3).

2. D1504:

D1504 means the optical density for giving a larger exposure by 0.4 in terms of logE than the amount of exposure necessary for giving an optical density of 1.5.

3. Preservability:

Each sample was stored at 50° C. and 70 % RH for 3 days and then exposed and processed in the same manner as in the fresh processing process mentioned above, and the photographic properties of the processed samples were evaluated in the same manner as above.

The test results obtained are shown in Table 1 below.

TABLE 1

| Sample No. | Emulsion | Compound of Formula (I) | Compound of Formula (II) Kind | Compound of Formula (II) Amount Added (mol/mol of Ag) | Photographic Properties of Fresh Samples γ | Photographic Properties of Fresh Samples D1504 | Photographic Properties of Stored Samples (Preservability) γ | Photographic Properties of Stored Samples (Preservability) D1504 | Remarks |
|---|---|---|---|---|---|---|---|---|---|
| 101 | Emulsion (A) | I-1 | — | — | 6.5 | 4.36 | 6.5 | 4.38 | comparative sample |
| 102 | Emulsion (A) | I-1 | II-9 | $1.3 \times 10^{-3}$ | 18.7 | 4.75 | 17.9 | 4.71 | sample of the invention |
| 103 | Emulsion (A) | I-1 | II-9 | $2.6 \times 10^{-3}$ | 21.4 | 4.98 | 20.2 | 4.93 | sample of the invention |
| 104 | Emulsion (A) | I-46 | — | — | 6.5 | 4.28 | 6.5 | 4.30 | comparative sample |
| 105 | Emulsion (A) | I-46 | II-11 | $1.3 \times 10^{-3}$ | 20.4 | 5.00 | 20.0 | 5.10 | sample of the invention |
| 106 | Emulsion (A) | I-46 | II-11 | $2.6 \times 10^{-3}$ | 23.5 | 5.12 | 21.5 | 5.05 | sample of the invention |
| 107 | Emulsion (A) | I-48 | — | — | 6.5 | 4.30 | 6.5 | 4.30 | comparative sample |
| 108 | Emulsion (A) | I-48 | II-1 | $2.6 \times 10^{-3}$ | 18.9 | 4.94 | 18.0 | 4.90 | sample of the invention |
| 109 | Emulsion (A) | I-48 | II-1 | $5.2 \times 10^{-3}$ | 23.4 | 5.11 | 22.0 | 5.04 | sample of the invention |
| 110 | Emulsion (A) | I-48 | II-9 | $1.3 \times 10^{-3}$ | 18.3 | 4.90 | 17.6 | 4.85 | sample of the invention |
| 111 | Emulsion (A) | I-48 | II-9 | $2.6 \times 10^{-3}$ | 22.2 | 5.08 | 21.7 | 5.05 | sample of the invention |
| 112 | Emulsion (A) | I-48 | II-12 | $1.3 \times 10^{-3}$ | 18.8 | 4.88 | 18.3 | 4.87 | sample of the invention |

TABLE 1-continued

| Sample No. | Emulsion | Compound of Formula (I) | Compound of Formula (II) Kind | Compound of Formula (II) Amount Added (mol/mol of Ag) | Photographic Properties of Fresh Samples γ | Photographic Properties of Fresh Samples D1504 | Photographic Properties of Stored Samples (Preservability) γ | Photographic Properties of Stored Samples (Preservability) D1504 | Remarks |
|---|---|---|---|---|---|---|---|---|---|
| 113 | Emulsion (A) | I-48 | II-12 | $2.6 \times 10^{-3}$ | 22.2 | 5.03 | 21.2 | 4.97 | sample of the invention |
| 114 | Emulsion (A) | I-48 | B-1 | $2.6 \times 10^{-3}$ | 6.5 | 4.25 | 6.5 | 4.26 | comparative sample |
| 115 | Emulsion (A) | I-48 | B-2 | $2.6 \times 10^{-3}$ | 6.5 | 4.28 | 6.5 | 4.25 | comparative sample |
| 116 | Emulsion (A) | I-48 | B-3 | $2.6 \times 10^{-3}$ | 6.5 | 4.31 | 6.5 | 4.30 | comparative sample |
| 117 | Emulsion (A) | I-48 | B-4 | $2.6 \times 10^{-3}$ | 6.5 | 4.27 | 6.5 | 4.30 | comparative sample |
| 118 | Emulsion (A) | I-48 | B-5 | $2.6 \times 10^{-3}$ | 6.5 | 4.33 | 6.5 | 4.29 | comparative sample |
| 119 | Emulsion (A) | I-48 | B-6 | $2.6 \times 10^{-3}$ | 19.0 | 5.10 | 12.1 | 4.45 | comparative sample |
| 120 | Emulsion (A) | I-51 | — | — | 6.5 | 4.33 | 6.4 | 4.31 | comparative sample |
| 121 | Emulsion (A) | I-51 | II-10 | $2.6 \times 10^{-3}$ | 21.8 | 5.16 | 20.1 | 5.10 | sample of the invention |
| 122 | Emulsion (A) | I-51 | II-13 | $2.6 \times 10^{-3}$ | 23.0 | 5.22 | 20.4 | 5.10 | sample of the invention |
| 123 | Emulsion (A) | I-51 | II-14 | $2.6 \times 10^{-3}$ | | | | | sample of the invention |
| 124 | Emulsion (A) | I-51 | B-6 | $2.6 \times 10^{-3}$ | 21.1 | 5.16 | 12.9 | 4.38 | comparative sample |

Comparative compounds used above are mentioned below.

Comparative Compound in Example 1

B-1

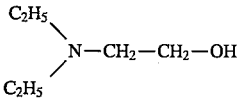

JP-A-56-106244

B-2

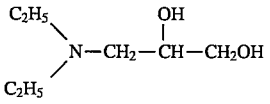

JP-A-56-106244

B-3

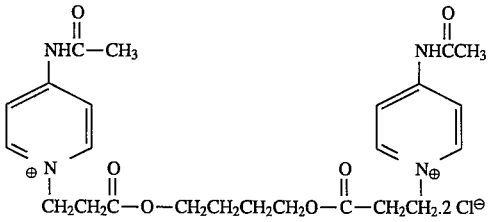

JP-A-60-140340

B-4

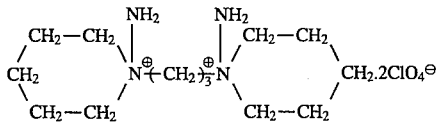

JP-A-60-140340

-continued

B-5

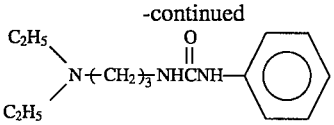

JP-A-60-140340

B-5

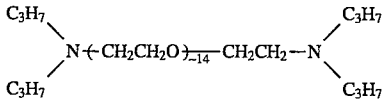

JP-A-4-51143

From the results in Table 1 above, it is noted that the samples not containing the compound of formula (II) or containing anyone of Comparative Compounds (B-1) to (B-5) were not almost hard and had a low Dmax value.

The fresh samples containing Comparative Compound (B-6) were almost comparable to the samples of the present invention with respect to the photographic properties, while the preservability of the former was much inferior to that of the latter. After stored, the gradation of the former became soft and Dm thereof greatly lowered. The preservability of the samples of the present invention was found far superior to that of the comparative samples. Both the fresh samples and the stored samples of the present invention were satisfactorily hard and had a sufficient Dmax value.

EXAMPLE 2

Coated photographic material samples were prepared in the same manner as in Example 1, except that the emulsions, the hydrazine derivatives of formula (I) and the compounds of formula (II) were varied to those indicated in Table 2 below.

The samples were processed in the same manner as in the fresh processing process in Example 1 and additionally by the running process mentioned below.

Running Process:

First, Sample No. 201 of Example 2, that had been exposed to have a blackening rate of 80 %, was processed with FG-460A using Developer (A) for one week at a rate of 5 $m^2$/day, while Developer (B) was replenished during the development at a rate of 400 ml/$m^2$ and the fresh fixer was replenished at a rate of 300 ml/$m^2$. Apart from this, it was processed for one week at a rate of 20 $m^2$/day, while the same replenishers were replenished at the same rates. The processing solution aged by the former running process was referred to as a small running solution, while that aged by the latter running process as a large running solution. Using the thus-aged processing solutions, the samples that had been exposed in the same manner as in Example 1 were processed, and the photographic properties of the thus-processed samples were evaluated in the same manner as in Example 1.

The test results are shown in Table 2 below.

TABLE 2

| Sample No. | Emulsion | Compound of Formula (I) | Compound of Formula (II) Kind | Compound of Formula (II) Amount Added (mol/mol of Ag) | Photographic Properties of Fresh Samples γ | Photographic Properties of Fresh Samples D1504 | Photographic Properties of Samples Processed with Small Running Solution γ | Photographic Properties of Samples Processed with Small Running Solution D1504 | Photographic Properties of Samples Processed with Large Running Solution γ | Photographic Properties of Samples Processed with Large Running Solution D1504 | Remarks |
|---|---|---|---|---|---|---|---|---|---|---|---|
| 201 | Emulsion (A) | I-27 | II-4 | $5.8 \times 10^{-3}$ | 19.4 | 4.96 | 20.0 | 5.10 | 18.8 | 4.87 | sample of the invention |
| 202 | Emulsion (A) | I-27 | II-8 | $5.8 \times 10^{-3}$ | 18.8 | 4.87 | 19.3 | 4.96 | 18.0 | 4.80 | sample of the invention |
| 203 | Emulsion (A) | I-27 | II-10 | $2.6 \times 10^{-3}$ | 20.0 | 5.06 | 20.8 | 5.15 | 19.4 | 4.93 | sample of the invention |
| 204 | Emulsion (A) | I-45 | II-8 | $5.8 \times 10^{-3}$ | 20.3 | 5.06 | 21.0 | 5.15 | 19.4 | 4.99 | sample of the invention |
| 205 | Emulsion (A) | I-45 | II-10 | $2.6 \times 10^{-3}$ | 22.4 | 5.13 | 23.0 | 5.16 | 20.8 | 5.02 | sample of the invention |
| 206 | Emulsion (A) | I-45 | II-12 | $2.6 \times 10^{-3}$ | 22.7 | 5.11 | 23.4 | 5.24 | 20.8 | 5.00 | sample of the invention |
| 207 | Emulsion (A) | I-47 | II-4 | $5.8 \times 10^{-3}$ | 20.3 | 5.10 | 21.0 | 5.16 | 19.4 | 4.93 | sample of the invention |
| 208 | Emulsion (A) | I-47 | II-11 | $2.6 \times 10^{-3}$ | 23.2 | 5.15 | 23.6 | 5.20 | 21.4 | 5.10 | sample of the invention |
| 209 | Emulsion (A) | I-54 | II-13 | $2.6 \times 10^{-3}$ | 23.0 | 5.15 | 23.6 | 5.22 | 21.2 | 5.08 | sample of the invention |
| 210 | Emulsion (B) | I-27 | II-8 | $5.8 \times 10^{-3}$ | 15.0 | 4.35 | 15.3 | 4.40 | 13.0 | 4.10 | comparative sample |
| 211 | Emulsion (B) | I-45 | II-10 | $2.6 \times 10^{-3}$ | 16.6 | 4.38 | 16.9 | 4.40 | 13.5 | 4.18 | comparative sample |
| 212 | Emulsion (B) | I-54 | II-13 | $2.6 \times 10^{-3}$ | 16.8 | 4.42 | 17.3 | 4.48 | 14.2 | 4.20 | comparative sample |
| 213 | Emulsion (C) | I-27 | II-8 | $5.8 \times 10^{-3}$ | 12.8 | 4.06 | 13.5 | 4.48 | 10.0 | 3.86 | comparative sample |
| 214 | Emulsion (C) | I-45 | II-10 | $2.6 \times 10^{-3}$ | 13.3 | 4.96 | 13.7 | 4.25 | 11.0 | 3.95 | comparative sample |
| 215 | Emulsion (C) | I-47 | II-11 | $2.6 \times 10^{-3}$ | 13.6 | 4.19 | 14.4 | 4.20 | 11.7 | 4.03 | comparative sample |
| 216 | Emulsion (C) | I-54 | II-13 | $2.6 \times 10^{-3}$ | 14.2 | 4.22 | 15.0 | 4.30 | 13.0 | 4.01 | comparative sample |

From the results in Table 2 above, it is noted that the fresh comparative samples containing Emulsion (B) or Emulsion (C) were soft and had a low Dmax and that these were much softer and had a lower Dmax when processed with the large running solution. As opposed to these, the samples of the present invention were all good, having a high γ and a high Dm, irrespective of the processing conditions. Precisely, the fresh samples of the present invention and also the samples of the present invention processed with the small running solution and the large running solution all had satisfactory photographic properties.

While the invention has been described in detail and with reference to specific embodiments thereof, it will be apparent to one skilled in the art that various changes and modifications can be made therein without departing from the spirit and scope thereof.

What is claimed is:

1. A method for forming an image which comprises processing a silver halide photographic material having provided on a support at least one silver halide emulsion layer which comprises silver halide grains containing a silver chloride of 50 mol % or more and at least one emulsion layer and other hydrophilic colloid layers contain at least one hydrazine derivative represented by formula (I) and at least one phosphonium salt compound represented by formula (II), is processed with a developer having a pH of from 9.0 to 11.0, $$R_1-\underset{\underset{A_1}{|}}{N}-\underset{\underset{A_2}{|}}{N}-G_1-R_2 \quad (I)$$

wherein $R_1$ is a group represented by formula (Ia), (Ib), (Ic), (Id) or (Ie)

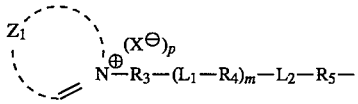

(Ia)

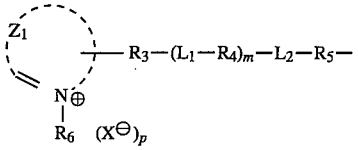

(Ib)

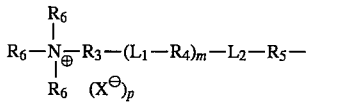

(Ic)

$$R_6-O-(L_3)_n-R_3-(L_1-R_4)_m-L_2-R_5- \quad \text{(Id)}$$

$$R_6-S-R_3-(L_1-R_4)_m-L_1-R_5- \quad \text{(Ie)}$$

wherein $L_1$, $L_2$, and $L_3$, may be the same or different and each represents —$CONR_7$—, —$NR_7CONR_8$—, —$SO_2NR_7$— or —$NR_7SO_2NR_8$—; $R_7$ and $R_8$ each represents a hydrogen atom, an alkyl group having from 1 to 6 carbon atoms, or an aryl group having from 6 to 10 carbon atoms; m and p each represents 0 or 1; $R_3$ and $R_4$ each represents a divalent aliphatic or aromatic group, $R_5$ represents an aliphatic group, aromatic group or a combined group thereof; $Z_1$ represents an aromatic group necessary for forming a nitrogen-containing aromatic ring; $R_6$ represents an aliphatic group or an aromatic group; $L_3$ represents —$CH_2CH_2O$—, —$CH_2CH(CH_3)O$— or —$CH_2CH_2(OH)CH_2O$—; X represents a counter ion; in which n is an integer of 3 or more, $G_1$ represents —CO—, —COCO—, —CS—, —$C(=NG_2R_2)$—, —SO—, —$SO_2$—, or —$P(O)(G_2R_2)$—; $G_2$ represents a chemical bond, —O—, —S—, or —$N(R_2)$—; $R_2$ represents an aliphatic group, an aromatic group, an amino group, or a hydrogen atom, and plural $R_2$'s, may be the same or different; and, one of $A_1$ and $A_2$ is a hydrogen atom, while the other represents a hydrogen atom, an acyl group, or an alkyl- or arylsulfonyl group;

(II)

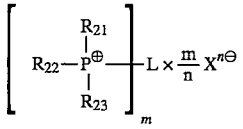

wherein $R_{21}$, $R_{22}$ and $R_{23}$ each represents an alkyl group, a cycloalkyl group, an aryl group, an alkenyl group, a cycloalkenyl group or a heterocyclic group m represents 1 or 2; L represents an m-valent organic group bonded to P atom in the formula via its carbon atom; n represents an integer of from 1 to 3; and X represents an n-valent anion, and X may be linked to L.

2. The method for forming an image as claimed in claim 1, wherein the silver halide emulsion is color-sensitized with a dye of formula (IV):

(IV)

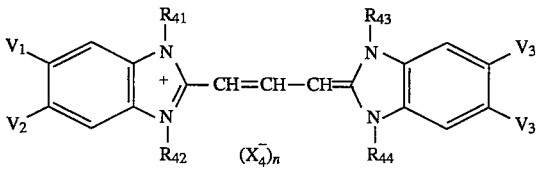

wherein $V_1$ and $V_3$ each represents a hydrogen atom or an electron-attracting group;

$V_2$ and $V_4$ each represents an electron-attracting group;

$R_{41}$, $R_{42}$, $R_{43}$ and $R_{44}$ may be the same or different and each represents an alkyl or alkenyl group having 10 or less carbon atoms in total, and at least one of $R_{41}$, $R_{42}$, $R_{43}$ and $R_{44}$ is a group having a sulfo group or a carboxyl group;

$X_4$ represents a counter ion necessary for neutralizing the charge of the compound; and n represents 0 or 1, and when the compound forms an internal salt, n is 0.

3. The method for forming an image as claimed in claim 1, wherein the hydrazine derivative represented by formula (I) is added in an amount of $1\times10^{-6}$ to $5\times10^{-2}$ mol/mol Ag.

4. The method for forming an image as claimed in claim 1, wherein the developer contains a compound of the following formula (III) and a dihydroxybenzene-type developing agent in a ratio by concentration of from 0.03 to 0.12 and having a pH of from 9.0 to 11.0.

(III)

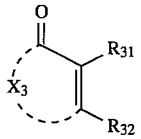

wherein $R_{31}$ and $R_{32}$ each represents a hydroxyl group, an amino group, an acylamino group, an alkylsulfonylamino group, an arylsulfonylamino group, an alkoxycarbonylamino group, a mercapto group, or an alkylthio group; and $X_3$ represents an atomic group necessary for forming a 5- or 6-membered ring along with the two vinyl carbon atoms substituted by $R_{31}$ and $R_{32}$ and the carbonyl carbon atom.

5. The method for forming an image as claimed in claim 1, wherein $R_1$ contains a substituent selected from the group consisting of an alkyl group, an aralkyl group, an alkenyl group, an alkynyl group, an alkoxy group, an aryl group, an amino group, an ureido group, an urethane group, an aryloxy group, a sulfamoyl group, a carbamoyl group, an alkylthio group, an arylthio group, a sulfonyl group, a sulfinyl group, a hydroxyl group, a halogen atom, a cyano group, —$SO_3M'$, —COOM' (where M' is a hydrogen atom, an alkali metal, a quaternary ammonium group or an alkaline earth metal), an aryloxycarbonyl group, an acyl group, an alkoxycarbonyl group, an acyloxy group, a carbonamido group, a sulfonamido group, and a phosphoric acid amide group.

6. The method for forming an image as claimed in claim 1, wherein at least one of $R_{21}$, $R_{22}$ and $R_{23}$ contains a substituent selected from the group consisting of an alkyl group, an aralkyl group, an alkenyl group, an alkynyl group, an alkoxy group, an aryl group, an amino group, an ureido group, an urethane group, an aryloxy group, a sulfamoyl group, a carbamoyl group, an alkylthio group, an arylthio group, a sulfonyl group, a sulfinyl group, a hydroxyl group, a halogen atom, a cyano group, —$SO_3M'$, —COOM' (where M' is a hydrogen atom, an alkali metal, a quaternary ammonium group or an alkaline earth metal), an aryloxycarbonyl group, an acyl group, an alkoxycarbonyl group, an acyloxy group, a carbonamido group, a sulfonamido group, and a phosphoric acid amide group, a nitro group, an alkyl or arylether group, an alkyl or arylthioether group, a carbamoyl group, a sulfamoyl group, a sulfoxy group and a carboxyl group.

7. The method for forming an image as claimed in claim 2, wherein at least one of $R_{41}$, $R_{42}$, $R_{43}$ and $R_{44}$ contains a substituent selected from the group consisting of a sulfo group, a carboxyl group, a halogen atom, a hydroxyl group, an alkoxycarbonyl or aryloxycarbonyl group having 8 or less carbon atoms, a mono-cyclic aryloxy group having 10 or less carbon atoms, an acyloxy group having 3 or less carbon atoms, a carbamoyl group, a sulfamoyl group, and an aryl group having 10 or less carbon atoms.

8. The method for forming an image as claimed in claim 1, wherein at least one of $R_3$ and $R_4$ contains a substituent selected from the group consisting of an alkyl group, an aralkyl group, an alkenyl group, an alkynyl group, an alkoxy group, an aryl group, an amino group, an ureido group, an urethane group, an aryloxy group, a sulfamoyl group, a carbamoyl group, an alkylthio group, an arylthio group, a sulfonyl group, a sulfinyl group, a hydroxyl group, a halogen atom, a cyano group, —$SO_3M'$, —COOM' (where M' is a hydrogen atom, an alkali metal, a quaternary ammonium group or an alkaline earth metal), an aryloxycarbonyl group, an acyl group, an alkoxycarbonyl group, an acyloxy group, a carbonamido group, a sulfonamido group, and a phosphoric acid amide group.

9. The method for forming an image as claimed in claim 1, wherein the amino group of $R_2$ in formula (I) is substituted by an alkyl group.

* * * * *